US006124849A

United States Patent [19]

Ito et al.

[11] Patent Number: 6,124,849

[45] Date of Patent: Sep. 26, 2000

[54] METHOD OF CONTROLLING ALTERNATING CURRENT PLASMA DISPLAY PANEL FOR IMPROVING DATA WRITE-IN CHARACTERISTICS WITHOUT SACRIFICE OF DURABILITY

[75] Inventors: Kazuhiro Ito; Tadashi Nakamura, both of Tokyo, Japan

[73] Assignee: NEC Corporation, Tokyo, Japan

[21] Appl. No.: 09/014,594

[22] Filed: Jan. 28, 1998

[30] Foreign Application Priority Data

Jan. 28, 1997 [JP] Japan ..... 9-014282
Nov. 7, 1997 [JP] Japan ..... 9-306013

[51] Int. Cl.[7] ..... G09G 5/00

[52] U.S. Cl. ..... 345/204; 315/169.2

[58] Field of Search ..... 345/60–63, 68, 345/67, 204; 315/169.1, 169.4, 169.2; 313/585, 586

[56] References Cited

U.S. PATENT DOCUMENTS

| | | | |
|---|---|---|---|
| 4,772,884 | 9/1988 | Weber et al. | 340/776 |
| 5,446,344 | 8/1995 | Kanazawa | 315/169.4 |
| 5,656,893 | 8/1997 | Shino et al. | 315/169.4 |
| 5,745,086 | 4/1998 | Weber | 345/60 |
| 5,790,087 | 8/1998 | Shigeta et al. | 345/67 |
| 5,828,356 | 10/1998 | Stoller | 345/60 |
| 5,854,540 | 12/1998 | Matsumoto et al. | 315/169.1 |
| 5,889,501 | 3/1999 | Sasaki et al. | 345/60 |
| 5,920,295 | 7/1999 | Takashashi et al. | 345/60 |

FOREIGN PATENT DOCUMENTS

| | | |
|---|---|---|
| 0549275 | 6/1993 | European Pat. Off. . |
| 0657861 | 6/1995 | European Pat. Off. . |
| 0680067 | 11/1995 | European Pat. Off. . |
| 4-172392 | 6/1992 | Japan . |
| 6-83283 | 3/1994 | Japan . |
| 7-36408 | 2/1995 | Japan . |
| 8-160912 | 6/1996 | Japan . |
| 9-62225 | 3/1997 | Japan . |

OTHER PUBLICATIONS

K. Yoshikawa et al., "A Full Color AC Plasma Display with 256 Gray Scale", *Japan Display '92*, 1992, pp. 605–608.

*Primary Examiner*—Vijay Shankar
*Assistant Examiner*—Vanel Frenel
*Attorney, Agent, or Firm*—Sughrue, Mion, Zinn, Macpeak & Seas, PLLC

[57] ABSTRACT

An alternating current plasma display panel selectively fires pixels for producing an image on a display area, a controlling method firstly supplies a negative sustain pulse to the scanning electrodes and the sustain electrodes so as to keep selected pixels fired and, thereafter, a positive sustain pulse to either scanning or sustain electrodes for putting the selected pixels into ready for perfectly erasing state, and pixels to be fired in the next field are surely selected from the perfectly erased pixels.

20 Claims, 17 Drawing Sheets

METHOD OF CONTROLLING ALTERNATING CURRENT PLASMA DISPLAY PANEL FOR IMPROVING DATA WRITE-IN CHARACTERISTICS WITHOUT SACRIFICE OF DURABILITY

FIELD OF THE INVENTION

This invention relates to an alternating current plasma display panel and, more particularly, to a method of controlling an alternating current plasma display panel for improving data write-in characteristics without sacrifice of durability.

DESCRIPTION OF THE RELATED ART

The plasma display panel has various attractive features such as a self-light emitting thin structure, a prompt response and a wide screen for producing a full-color large contrast image without flicker. These features are desirable for an interface between a computer and an operator and a full-color image production.

The plasma display panel is broken down into two categories. The first category is called as an alternating current plasma display panel. In the alternating current plasma display panel, electrodes are covered with dielectric layers, and alternating discharge indirectly takes place in the discharging space between the dielectric layers. The second category is called as a direct current plasma display panel. The direct current plasma display panel has electrodes exposed to the discharging space, and produces direct discharge The alternating current plasma display panel is further broken down into two sub-categories, i.e., a pulse memory driving type alternating current plasma display panel and a refresh type alternating current plasma display panel. The pixels of the pulse memory driving type alternating current plasma display panel have a kind of memory function, and the pulse memory driving type alternating current plasma display panel previously memorizes the selection in the pixels to be discharged before formation of a picture. The refresh type alternating current plasma display panel does not use the memory function. The brightness of the alternating current plasma display panel is proportional to the number of discharges or the repetition of pulse applied to the electrodes. However, when the display area is increased, the refresh type alternating current plasma display panel decreases the luminescence, and, for this reason, is appropriate for a small image display.

FIG. 1 illustrates the structure of a pixel incorporated in a typical example of the pixel incorporated in the prior art pulse memory driving type alternating current plasma display panel. The pixel largely comprises a back substrate structure 1 and a front substrate structure 2, and a partition wall 3 spaces the back substrate structure 1 from the front substrate 2. Discharging gas 4 such as helium, neon, xenon or gaseous mixture thereof fills the space between the back substrate structure 1 and the front substrate structure 2. The discharging gas emits ultra-violet light.

The back substrate structure 1 includes a transparent glass plate 1*a,* and a data electrode 1*b* is formed on the transparent glass plate 1*a*. The data electrode 1*b* is covered with a dielectric layer 1*c,* and a phosphor layer 1*d* is laminated on the dielectric layer 1*c*. The ultra-violet light is radiated onto the phosphor layer 1*d,* and the phosphor layer 1*d* converts the ultra-violet light to visible light. The visible light is radiated as indicated by arrow AR1.

The front substrate structure 2 includes a transparent glass plate 2*a,* and a scanning electrode 2*b* and a sustain electrode 2*c* are formed on the transparent glass plate 2*a*. The scanning electrode 2*b* and the sustain electrode 2*c* extend in the perpendicular direction to the data electrode 1*b*. Tracing electrodes 2*d*/2*e* are laminated on the scanning electrode 2*b* and the sustain electrode 2*c,* respectively, and are operative to reduce the resistance against a scanning pulse signal and a sustain pulse signal. These electrodes 2*b,* 2*c,* 2*d* and 2*e* are covered with a dielectric layer 2*f,* and the dielectric layer 2*f* is overlain by a protective layer 2*g*. The protective layer 2*g* is formed of magnesium oxide, and prevents the dielectric layer 2*f* from the discharge.

The prior art pixel shown in FIG. 1 produces a piece of image as follows. Firstly, an initial pulse is applied between the scanning electrode 2*b* and the data electrode 1*b,* and is larger than the discharging threshold. Discharge takes place through the discharging gas 4. Positive charge and negative charge are attracted toward the dielectric layers 2*f*/1*c* over the scanning electrode 2*b* and the data electrode 1*b,* and are accumulated thereon as wall charges. The wall charges produce potential barriers, and gradually decrease the effective potential. For this reason, even if the initial pulse is continuously applied between the scanning electrode 2*b* and the data electrode 1*b,* the prior art pixel stops the discharge.

Thereafter, a sustain pulse is applied between the scanning electrode 2*b* and the sustain electrode 2*c,* and is identical in polarity with the wall potential. The wall potential is superposed on the sustain pulse. For this reason, even though the amplitude of the sustain pulse is low, the total potential exceeds the discharging threshold, and continues the discharge. Thus, while the sustain pulse is being applied between the scanning electrode 2*b* and the sustain electrode 2*c,* the sustain discharge is continued. This is the memory function.

When an erase pulse is applied between the scanning pulse 2*b* and the sustain pulse 2*c,* the wall potential is canceled, and the pixel stops the sustain discharge. The erase pulse is a wide in pulse width and low in amplitude, or is narrow in pulse width and as low in amplitude as the sustain pulse.

FIG. 2 illustrates the layout of pixels incorporated in the pulse memory driving type alternating current plasma display panel. The pixel 5 are identical in structure with the prior art pixel shown in FIG. 1, and form a display area 6. The pixels 5 are arranged in j rows and k columns, and a small box stands for each pixel 5 in FIG. 2. Scanning electrodes Sc1 to Scj and sustain electrodes Su1 to Suj extend in the direction of rows, and the scanning electrodes Sc1 to Scj are respectively paired with the sustain electrodes Su1 to Suj. The pairs of scanning/sustain electrodes Sc1/Su1 to Scj/Suj are respectively associated with the rows of pixels 5. On the other hand, data electrodes D1 to Dk extend in the direction of columns, and are associated with the columns of pixels 5, respectively.

FIG. 3 illustrates a prior art method of controlling an alternating current plasma display panel. The prior art method is hereinbelow referred to as "first prior art controlling method". Priming discharge period A, write-in period B and sustain discharge period C form each field, and the prior art alternating current plasma display panel repeats the field so as to form a picture on the display area 6. The priming discharge period A may be deleted from the field.

Active particles and the wall charges are produced in the priming discharge period A so as to obtain stable write-in discharge characteristics. A negative priming discharge pulse Pp is applied to all the sustain electrode Su1 to Suj, and causes the priming discharge to take place in all the pixel 5.

The priming discharge produces the wall charges. A negative erase pulse Ppe is concurrently supplied to the scanning electrodes Sc1 to Scj, and erases the wall charge undesirable for write-in discharge and sustain discharge.

In the write-in period B, a negative scanning pulse Pw is sequentially supplied to the scanning electrodes Sc1 to Scj, and a positive data pulse Pd is selectively supplied to the data electrodes D1 to Dk associated with the pixels to be fired in synchronism with the scanning pulse Pw. Then, write-in-discharge takes place in pixels 5 to be fired, and the wall charge is produced for the pixel 5. The photo-emitting current starts to flows at respective timings when both scanning and data pulses Pw/Pd are applied between the scanning electrodes Sc1 to Scj and the data electrodes D1 to Dk.

In the sustain discharge period C, a negative sustain pulse Pc is supplied to the sustain electrodes Su1 to Suj, and, another negative sustain pulse Ps is supplied to the scanning electrodes Sc1 to Scj. The negative sustain pulse Ps is different in phase from the negative sustain pulse Pc by 180 degrees. The negative sustain pulses Pc/Ps maintain the brightness of the pixel 5 selected in the write-in period B. After application of the last negative sustain pulse Pce, a negative erase pulse Pse is concurrently supplied to the scanning electrodes Sc1 to Scj, and erases the wall charge. As a result, the pixels 5 stops the sustain discharge.

Another prior art controlling method is disclosed by K. Yoshikawa et al. in "A Full Color AC Plasma Display with 256 Gray Scale", JAPAN DISPLAY '92, pages 605 to 608, and FIG. 4 illustrates the prior art controlling method disclosed in the paper. The prior art controlling method hereinbelow is referred to as "second prior art controlling method". Although the authors use different terms in the paper, step 1 to step 3 of the address period correspond to the priming discharge period A, and step 4 of the address period is corresponding to the write-in discharge period B. The sustain discharge period C is referred to as "sustain period" in the paper. The data electrodes D1 to Dk, the sustain electrodes Su1 to Suj and the scanning electrodes Sc1 to Scj are corresponding to address electrodes AD, sustain electrodes X and sustain electrodes Y1 to Y480, respectively.

In the priming discharge period A, a positive erase pulse Psec is firstly applied to the sustain electrodes X, and Erases the wall charge produced in the previous field. Subsequently, a positive priming discharge Ppc is concurrently supplied to the sustain electrodes y1 to Y480, and produces two kinds of wall charges through priming discharge. Thereafter, a positive erase pulse Ppec is applied to the sustain electrodes X, and erases one of the two kinds of wall charges undesirable for write-in discharge and sustain discharge.

In the write-in discharge period B, the sustain electrodes X are changed to a positive high potential level, and a scan pulse Pw sequentially changes the sustain electrodes Y1 to Y480 from a positive potential level to the ground level. A positive address pulse Pd is selectively applied to the address electrodes AD, and the scanning pulse Pw and the positive address pulse Pd specify pixels 5 to be fired.

In the sustain discharge period C, a positive sustain pulse Psus is periodically supplied to the sustain electrodes X, and a positive sustain pulse Psue is also periodically supplied to the sustain electrodes Y1 to Y480. The positive sustain pulse Psus is different from the positive sustain Psue by 180 degrees. The positive sustain pulses Psus/Psue maintain the sustain discharge, and the selected pixels 5 are fired.

As described hereinbefore, the gradation is changed by controlling the number of sustain pulses. A sub-field technology is appropriate for high brightness. FIG. 5 illustrates the sub-field technology for controlling the gradation. A single field is divided into sub-fields SF1, SF2, SF3, SF4, SF5 and SF6, and a picture is produced through the field. Although the time period for each field is variable depending upon the computer/broadcasting system, the field usually ranges from 1/50 second to 1/75 second. A field is divided into k sub-fields, and k is 6 in the example shown i FIG. 5.

The sub-field consists of the priming discharge period A, the write-in discharge period B and the sustain discharge period C. In the example shown in FIG. 5, only the sub-field SF6 has all the periods A/B/C, and the priming discharge period A is deleted from the other sub-fields SF5 to SF1, because the pixels maintain the effect of the priming discharge A through the field. However, the priming discharge period A may be inserted in another sub-field.

The brightness Br of each pixel is given by equation 1.

$$Br = \sum_{n=1}^{k} (LI \times 2^{n-1}) \times a_n \qquad \text{equation 1}$$

where k is the number of sub-fields incorporated in the field, n is the position of each sub-field, L1 is the brightness in the darkest sub-field and $a_n$ is either 1 or 0. The brightest sub-field has the position n=k , and the darkest sub-field has the position n−1. When a pixel emits the light in a sub-field, $a_n$ is 1 in the sub-field. On the other hand, when the pixel is not expected to emit the light in another sub-field, $a_n$ is changed to zero.

In the example shown in FIG. 5, the field is divided into six sub-fields, and the sub-field technology achieves 64 gray scale, i.e., $2^k=2^6=64$. If the plasma display is designed to produce a full color image, each of the three primary colors has 64 grades, and the prior art alternating current plasma display panel can produce 262144 colors, i.e., $64^3$. When the field is not divided into a plurality of sub-fields, each of the three primary colors has two grades, i.e., on/off, and the prior air alternating current plasma display panel can produce 8 colors.

The prior art controlling methods repeatedly apply the sustain discharge pulses Pc/Ps and Psus/Psue to the sustain/scanning electrodes Su1–Suj/Sc1–Scj and X/Y1–Y480, and the sustain discharge pulses are either negative or positive with respect to the potential level on the data electrodes D1–Dk and AD.

When the sustain discharge pulses have negative large potential with respect to the potential level on the data electrodes, the ion is attracted toward the protective layer 2*g*, and the phosphor layer 1*d* is not subjected to the ion-bombardment in the sustain discharge period. For this reason, the negative sustain pulses prolong the duration of life, and improves the durability of the prior art alternating current plasma display. However, the negative sustain pulses deteriorate the data write-in characteristics of the prior art alternating current plasma display panel. In detail, the last sustain pulse is also negative with respect to the data electrodes, and the erase pulse requires a large height in the sustain discharge period. The erase pulse with the large height causes the negative wall charge to remain over the data electrodes, and the negative wall charge reduces the effective potential of the data pulse Pd and the effective potential of the scanning pulse Pw. This results in the deterioration of the data write-in characteristics.

FIGS. 6A and 6B illustrates the wall charges produced in the sustain discharge period through the first prior art controlling method. The pixel is assumed to be controlled through the first prior art controlling method. When the last sustain pulse Pce is applied to the sustain electrode 2*c,* the positive wall charge is induced over the sustain electrode 2*c,* and the negative wall charge is accumulated under the sustain electrode 2*b* and over the data electrode 1*b* as shown in FIG. 6A. The electric force lines 10 are directed from the sustain electrode 2*c* to the scanning electrode 2*b* and the data electrode 1*b.* In this situation, the ion is hardly directed toward the magnesium oxide layer 2*g* under the scanning electrode 2*b,* and the secondary electron is not emitted. Thus, secondary discharge due to the internal potential hardly takes place after the application of the last erasing pulse.

Subsequently, the erase pulse Pse is applied to the scanning electrode 2*b,* and the internal potential due to the wall charge is superposed thereon. Then, the erasing discharge takes place between the scanning electrode 2*b* and the sustain electrode 2*c.* However, the secondary discharge due to the wall charge hardly takes place, and the erase pulse requires large pulse height. After the erasing discharge, the internal potential between the scanning electrode 2*b* and the sustain electrode 2*c* is removed. The erase pulse with the large pulse height induces the negative wall charge on the phosphor layer 1*d* over the data electrode 1*b* as shown in FIG. 6B. Thus, the negative wall charge is left on the phosphor layer 1*d* over the data electrode 1*b* after the erasing discharge. The negative wall charge gives rise to increase the potential required for the data write-in, because the potential due to the data pulse Pd and the scanning pulse Pw is opposite in polarity to the internal potential due to the negative wall charge.

If the negative wall charge is much, the dispersion of wall charge between the pixels is serious, and the data pulse Pd is expected to take up the dispersion. This results in a higher pulse height, and a data drive IC controlling data electrodes is expected to withstand the large potential. However, the withstand voltage is presently of the order of 130 volts, and would be damaged. For this reason, it is impossible to increase the pulse height of the data pulse Pd. The insufficient pulse height can not make all the pixels to be fired ready for firing state. This means some pixel is not fired. As a result, the prior art alternating current plasma display panel incorrectly produces a picture on the display area.

The large pulse height is not required for the second prior art controlling method. However, the phosphor layer 1*d* is much liable to be damaged, and makes the alternating current plasma display panel not durable. In detail, FIGS. 7A and 7B illustrate the wall charges produced in the sustain discharge period through the second prior art controlling method. The positive sustain pulse Psue is finally applied to the scanning electrode 2*b* in the sustain discharge period. The positive sustain pulse Psue induces the negative wall charge under the scanning electrode 2*b,* and the positive wall charge is accumulated under the sustain electrode 2*c* and over the data electrode 1*b* as shown in FIG. 7A. The electric force lines are directed toward the scanning electrode 2*b,* and the magnesium oxide layer 2*g* is liable to emit the secondary electron due to the ion bombardment. Thereafter, the positive erasing pulse Psec is applied to the sustain electrode 2*c,* and is superposed on the internal potential due to the wall charges. Then, the erasing discharge takes place between the scanning electrode 2*b* and the sustain electrode 2*c.* The internal potential due to the wall charges promotes the erasing discharge, and the erasing pulse Psec has a relatively small pulse height.

The erasing discharge removes the internal potential between the scanning electrode 2*b* and the sustain electrode 2*c,* and only a small amount of negative wall charge is left over the data electrode 1*b* as shown in FIG. 7B. The dispersion of wall charge is less than that of the pixels controlled by using the first prior art controlling method, and the data pulse Pd does not required a large pulse height. For this reason, the second prior art controlling method is desirable rather than the first prior art controlling method.

However, the second controlling method encounters a problem in the durability of the phosphor layer 1*d.* The positive sustain pulses Psus/Psue are respectively applied to the sustain electrode 2*c* and the scanning electrode 2*b,* and the data electrode 1*b* is maintained at the ground level. For this reason, the ion is attracted toward the data electrode 1*b,* and the phosphor layer 1*d* is subjected to ion bombardment. The ion bombardment damages the phosphor layer 1*d,* and deteriorates it. As a result, the pixel rapidly decreases the brightness, and the alternating current plasma display is not durable.

Thus, there is a trade-off between the data write-in characteristics and the durability of the alternating current plasma display, and both first and second prior art controlling methods can not satisfy both requirements.

SUMMARY OF THE INVENTION

It is therefore an important object of the present invention to provide a method of controlling an alternating current plasma display panel which makes the alternating current plasma display panel durable without sacrifice of the data write-in characteristics.

To accomplish the object, the present invention proposes to apply a sustain pulse positive with respect to data electrodes to either sustain or scanning electrodes after application of a negative sustain pulse.

In accordance with one aspect of the present invention, there is provided a method of controlling an alternating current plasma display panel including a plurality of data electrodes covered with a first dielectric structure, a plurality of scanning electrodes covered with a second dielectric structure spaced from the first dielectric structure for forming a space filled with discharging gas and a plurality of sustain electrodes covered with the second dielectric structure and respectively paired with the plurality of scanning electrodes for forming a plurality of electrode pairs, each of the plurality of data electrodes and each of the plurality of electrode pairs of defining one of a plurality of pixels selectively fired, and the method comprises the steps of a) applying a scanning pulse sequentially to the plurality of scanning electrodes and a data pulse selectively to the plurality of data electrodes so as to create a first internal potential available for firing in select certain pixels selected from the plurality of pixels and b) alternately applying a first sustain pulse negative with respect to a potential level on the plurality of data electrodes to the plurality of sustain electrodes and the plurality of scanning electrodes so as to make the certain pixels fired, c) applying a second sustain pulse positive with respect to the potential level on the plurality of data electrodes to either sustain or scanning electrodes so as to accumulate wall charges on the first insulating structure and the second insulating structure for creating a second internal potential expressed by a first electric force line directed from the first insulating structure to the second insulating structure and a second electric force line between a first area of the second insulating structure adjacent to the plurality of scanning electrodes and a second area of the second insulating structure adjacent to the plurality of sustain electrodes, and d) erasing the wall charges from the first insulating structure and the second insulating structure.

BRIEF DESCRIPTION OF THE DRAWINGS

The features and advantages of the method will be more clearly understood from the following description taken in conjunction with the accompanying drawings in which.

DESCRIPTION OF THE PREFERRED EMBODIMENTS

First Embodiment

Figure 1:
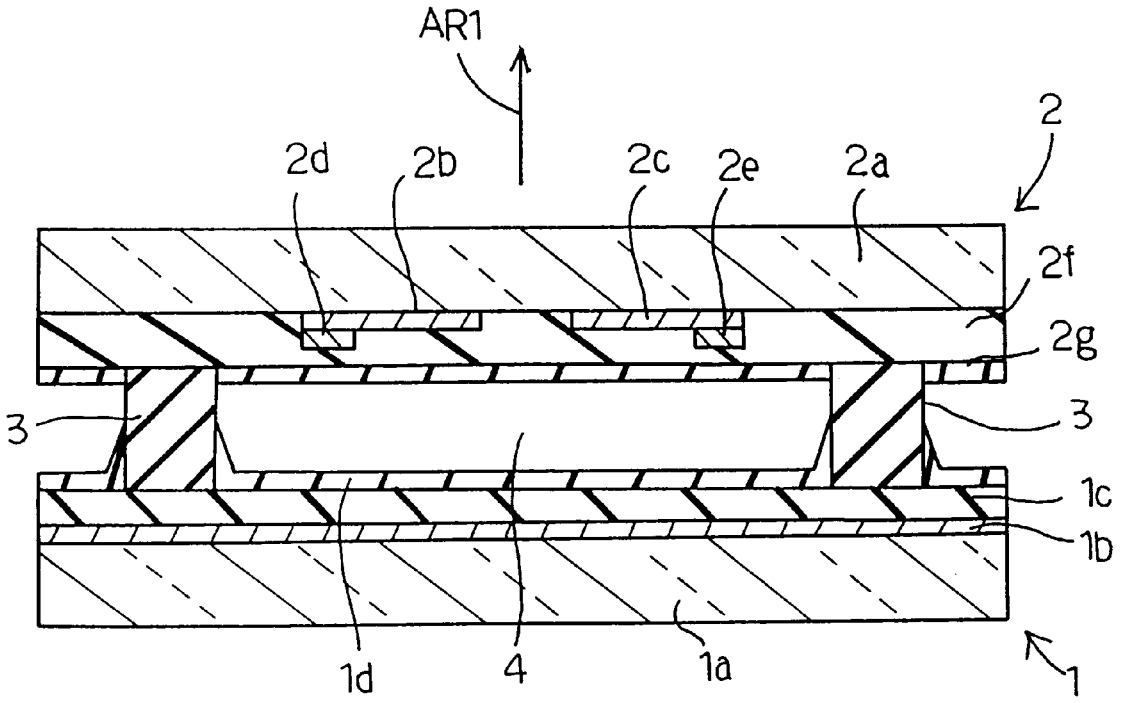
Fig. 1 PRIOR ART
FIG. 1 is a cross sectional view showing the structure of the pixel.
Figure 2:
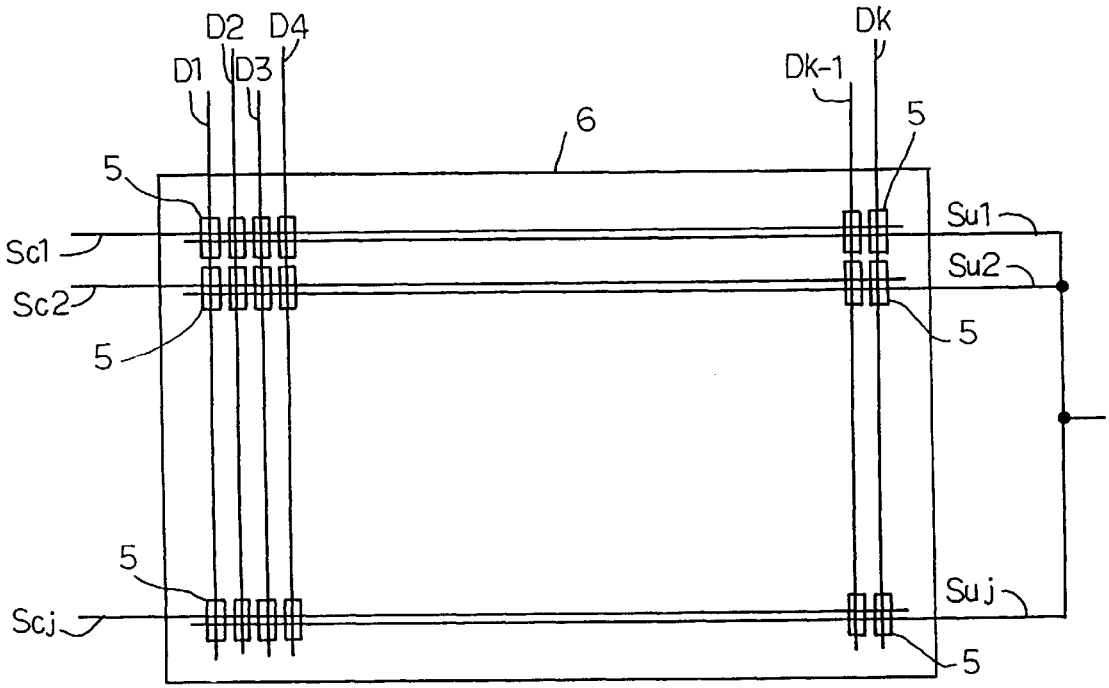
Fig. 2 PRIOR ART
FIG. 2 is a plane view showing the layout of the pixels and the associated electrodes.
Figure 3:
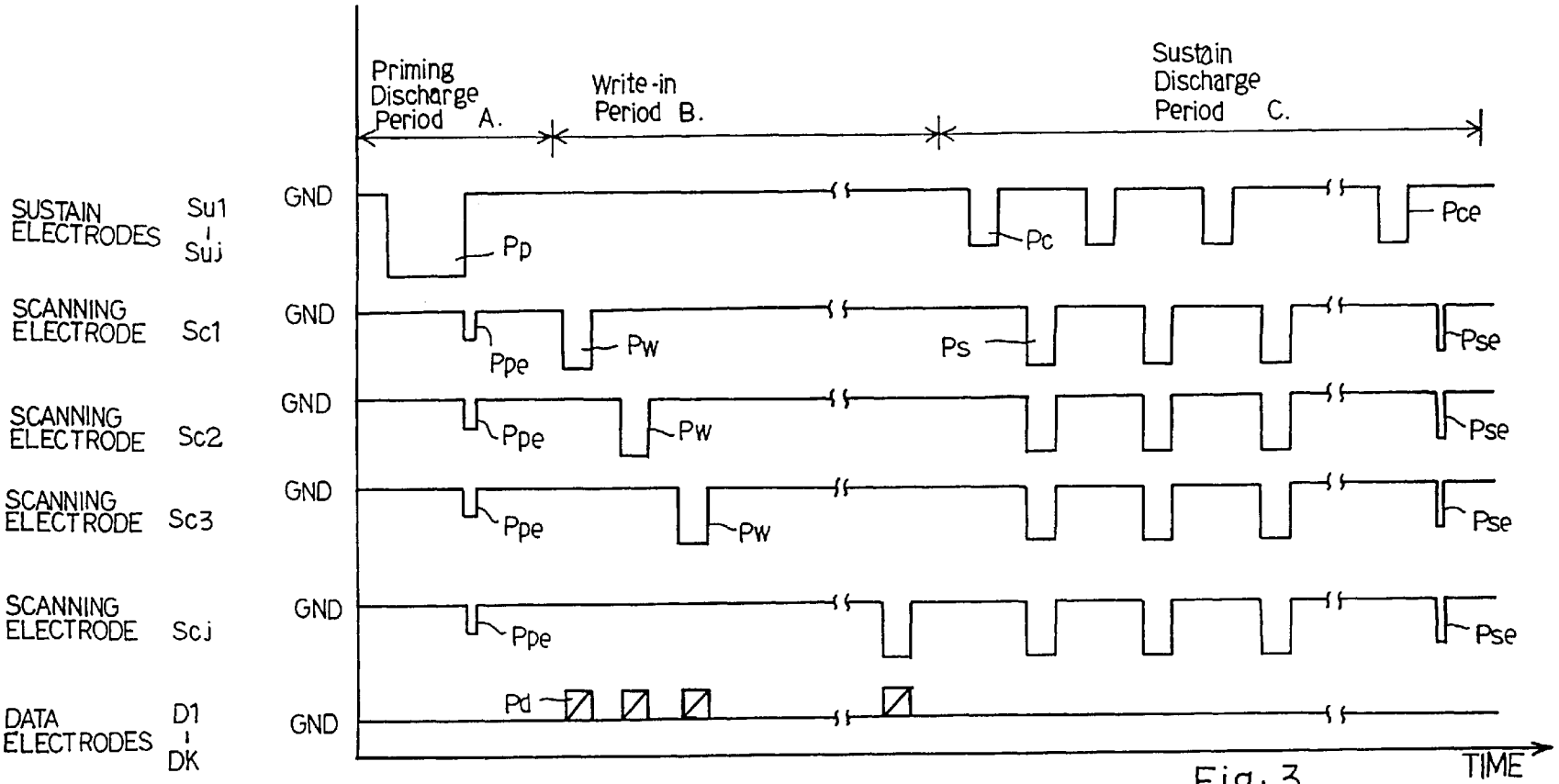
Fig. 3 PRIOR ART
FIG. 3 is a timing chart showing the first prior art controlling method.
Figure 4:
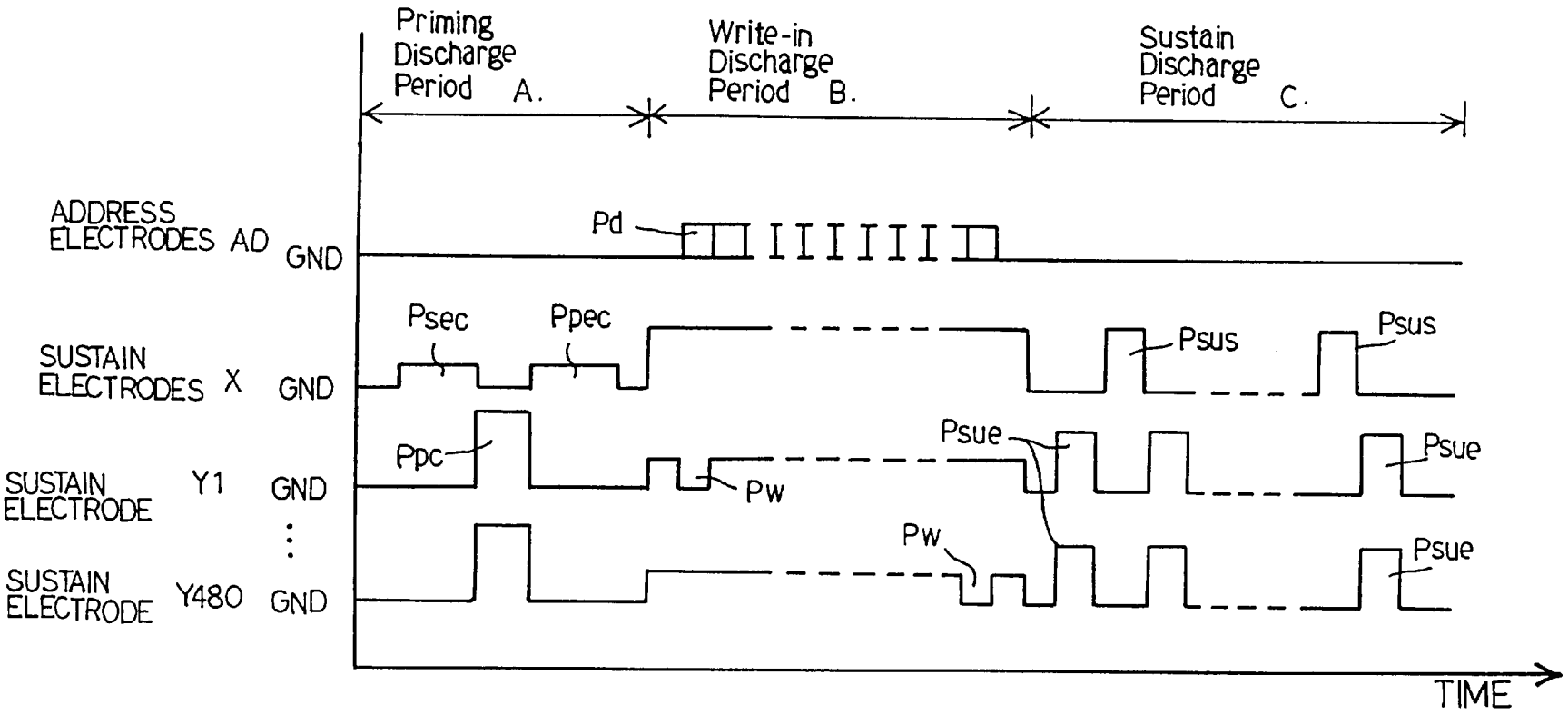
Fig. 4 PRIOR ART
FIG. 4 is a timing chart showing the second prior art controlling method disclosed in the paper entitled as "A Full Color AC Plasma Display with 256 Gray Scale"
Figure 5:
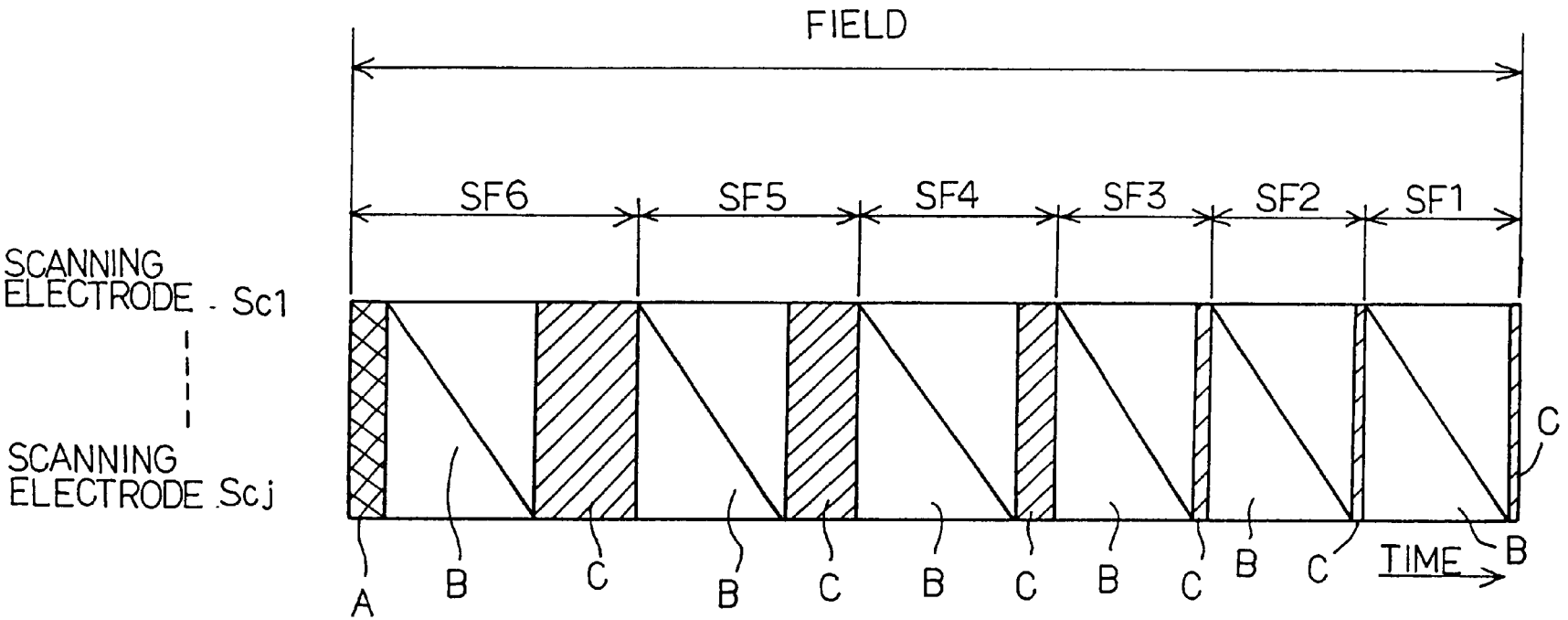
Fig.5 PRIOR ART
FIG. 5 is a view showing the sub-field technology for controlling the gradation.
Figure 6A:
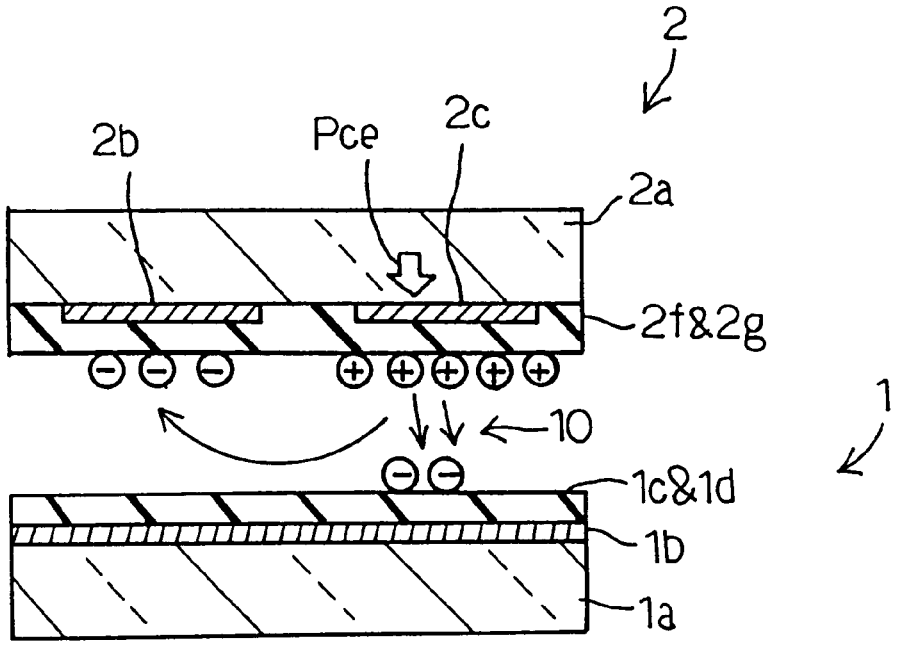
Fig. 6A PRIOR ART
FIGS. 6A and 6B are cross sectional views showing the wall charges produced in the pixel during the sustain discharge period through the first prior art controlling method.
Figure 6B:
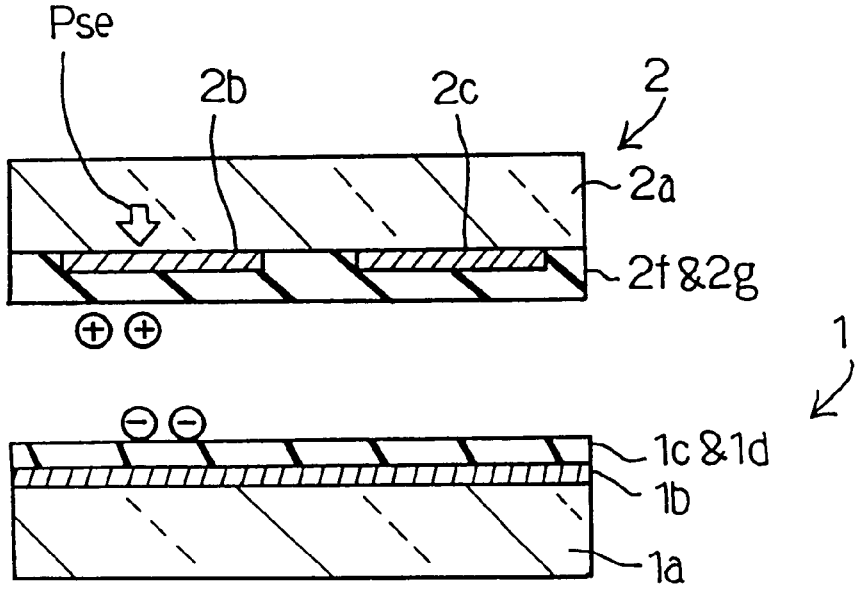
Fig. 6B PRIOR ART
Figure 7A:
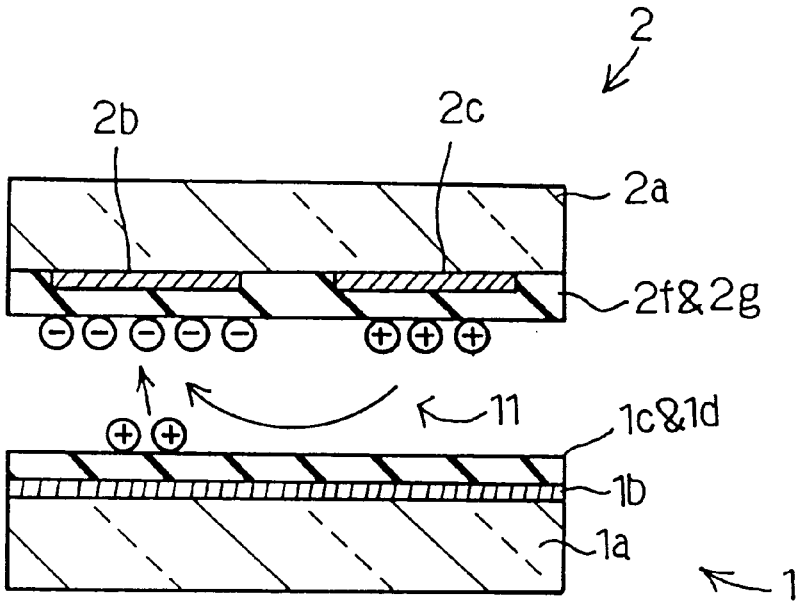
Fig. 7A PRIOR ART
FIGS. 7A and 7B are cross sectional views showing the wall charges produced in the pixel during the sustain discharge period through the second prior art controlling method.
Figure 7B:
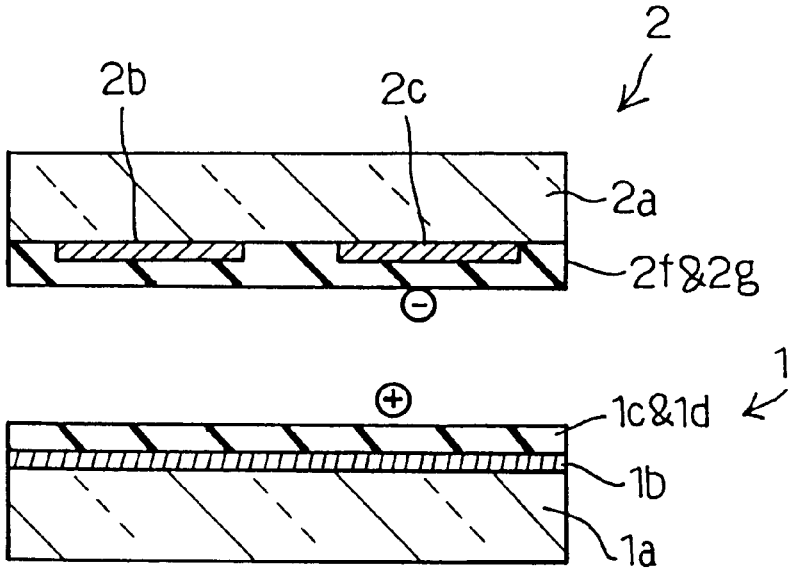
Fig. 7B PRIOR ART
Figure 8:
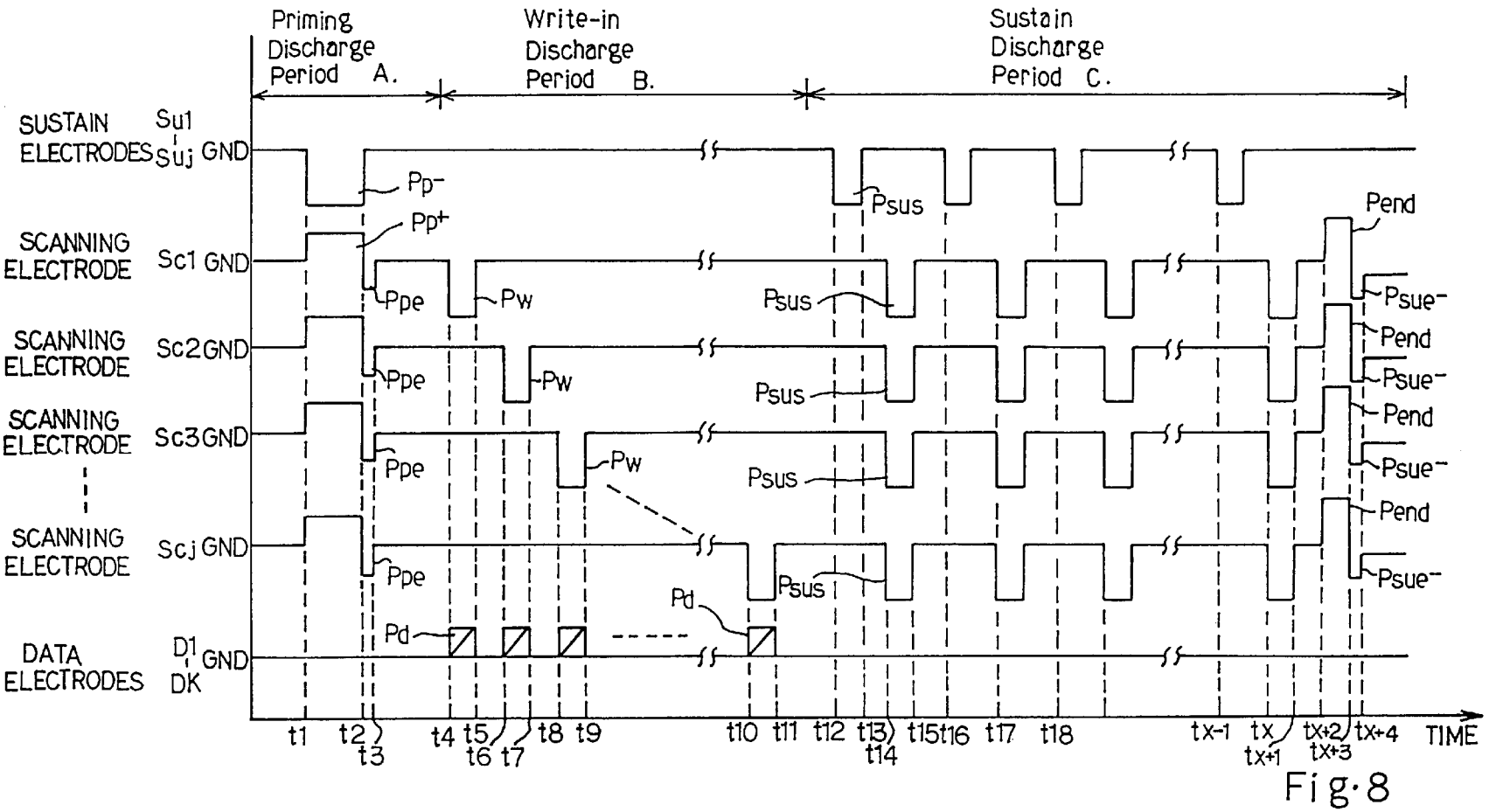
FIG. 8 is a timing chart showing a method of controlling an alternating current plasma display panel according to the present invention.

FIG. 8 illustrates a controlling method embodying the present invention. The controlling method is available for the alternating current plasma display panel shown in FIGS. 1 and 2, and description is concentrated on the controlling method. However, the references for the electrodes and the layers are inserted into the following description. In the following description, the polarity is determined with respect to the potential level on the data electrodes 1*b*/D1–Dk. A single sub-field is shown in FIG. 8, and the sub-field is repeated for producing a picture on the display area 6. However, the priming discharge period A may be selectively deleted from the second to the last sub-fields.

The sub-field shown in FIG. 8 consists of the priming discharge period A, the write-in discharge period B and the sustain discharge period C. All of the pixels 5 are fired in the priming discharge period A, and pixels 5 to be fired are selected from the pixel array in the write-in discharge period B so as to produce an image on the display area 6. The selected pixels 5 are continuously fired in the sustain discharge period C, and the sustain discharge is selectively repeated over the sustain discharge period C so as to give a gradation to each of the pixels 5.

A negative priming pulse Pp− is supplied to all the sustain electrodes Su1 to Suj between time t1 and t2. The negative priming pulse Pp− has the pulse height ranging from 170 volts to 200 volts, and the pulse width is between 5 microseconds to 20 microseconds. On the other hand, a positive priming pulse Pp+ is supplied to all the scanning electrodes Sc1 to Scj between time t1 and time t2, and the negative priming pulse Pp− and the positive priming pulse Pp− are recovered to the ground level GND at time t2. A negative erasing pulse Ppe follows the positive priming pulse Pp+. The negative erasing pulse Ppe goes down at time t2, and is recovered to the ground level at time t3. The positive priming pulse Pp+ has the pulse height ranging from 170 volts to 200 volts, and the pulse width is also between 5 microseconds to 20 microseconds. The pulse height of the negative erasing pulse Ppe ranges from 50 volts to 150 volts, and the pulse width is as narrow as the minimum pulse width ranging from 0.5 microsecond to 2 microseconds. The pulse width of the negative erasing pulse Ppe preferably ranges from 0.5 microsecond to 2 microsecond.

A large potential difference takes place between the sustain electrodes Su1 to Suj and the scanning electrodes Sc1 to Scj, and all the pixels 5 are fired when the potential difference exceeds the threshold for discharge. However, the potential difference between the data electrodes D1–Dk and the sustain/scanning Su1–Suj/Sc1–Scj does not exceed the threshold, and any discharge does not take place therebetween. The priming discharge produces two kinds of wall charges, and creates an internal potential. The internal potential is superposed on the negative erasing pulse Ppe, and erasing discharge takes place so as to cancel the wall charge undesirable for the write-in discharge.

Upon completion of the erasing operation, the controlling method enters into the write-in discharge period B, and the pixels 5 to be fired are specified through a data write-in. In detail, a negative scanning pulse Pw is sequentially supplied to the scanning electrodes Sc1 to Scj, and a positive data pulse Pd is selectively applied to the data electrodes D1 to Dk. The negative scanning pulse Pw has the pulse height between 170 volts and 200 volts and the pulse width of the order of 3 microseconds. On the other hand, the positive data pulse Pd has the pulse height between 50 volts and 80 volts, and the pulse width is equal to the negative scanning pulse Pw. The negative scanning pulse Pw and the positive data pulse Pd specifies the pixels 5 to be fired. If the negative scanning pulse Pw and the positive data pulse Pd are concurrently applied to a pixel 5, the pixel 5 is fired. However, if the negative scanning pulse Pw and the positive data pulse Pd are applied to a pixel 5 at different timings, the pixel 5 is never fired.

In this instance, the negative scanning pulse Pw is applied to the scanning electrode Sc1 between time t4 and time t5, the scanning electrode Sc2 between time t6 and time t7, the scanning electrode Sc3 between time t8 and time t9, . . . and the scanning electrode Scj between time t10 and time t11, and the positive data pulse Pd is selectively applied to the data electrodes D1 to Dk between time t4 and time t5, between time t6 and time t7, between time t8 and time t9, . . . and between time t10 and time t11. If the positive data pulse Pd is applied to the data electrodes D1 and D2 between time t4 and times t5, only the pixels at the crossing point between the scanning electrode Sc1 and the data electrodes D1/D2 are fired.

After time t11, the alternating current plasma display panel enters into the sustain discharge period C. A negative sustain pulse Psus is applied to all the sustain electrodes Su1 to Suj between time t12 and time t13, and is applied to all the scanning electrodes Sc1 to Scj between time t14 and time t15. The negative sustain pulse Psus has the pulse height ranging between 170 volts and 200 volts, and the pulse width is 3 microseconds. The negative sustain pulse Psus is alternately supplied to the sustain electrodes Su1 to Suj and the scanning electrodes Sc1 to Scj at time t16, time t17, time t18, . . . , time tx−1 and time tx. The negative sustain pulse Psus repeatedly fires the pixels 5 selected in the write-in discharge period B, and the repetition of firing is controlled so as to regulate each pixel 5 to a target brightness. The ion is attracted toward the protective layer 2*g* during the sustain discharge period C, and the phosphor layer 1*d* is never damaged.

After the recovery of the negative sustain pulse Psus to the ground level GND at time tx+1, a positive sustain pulse Pend is applied to all the scanning electrodes Sc1 to Scj between time tx+2 and time tx+3, and a negative erasing pulse Psue- is further applied to the scanning electrodes Sc1 to Scj between time tx+3 and time tx+4. The positive sustain pulse Pend has the pulse height ranging between 160 volts and 200 volts, and the pulse width falls the range from 3 microseconds to 20 microseconds. On the other hand, the negative erasing pulse Psue- has the pulse height between 50 volts and 100 volts, and the pulse width ranges from 0.5 microsecond to 2 microseconds and, preferably, between 0.5 microsecond to 1 microsecond.

The positive sustain pulse Pend first the selected pixels 5, and the negative e erasing pulse Psue- causes erasing discharge to take place so as to erase the wall charge. However, the non-selected pixels 5 are never fired in the sustain discharge period C, because the negative sustain pulse Psus, the positive sustain pulse Pend and the negative erasing pulse Psue- do not cause the potential between the electrodes to exceed the threshold for the discharging.

It is necessary to carefully determine the pulse height of the positive sustain pulse Pend, because the threshold for discharge is varied together with the composition of the discharging gas. If the positive sustain pulse Pend has a pulse height large enough to generate the discharge in non-selected pixels 5, the sustain discharge in the non-selected pixels 5 decreases the contrast on the display area 6.

Figure 9A:
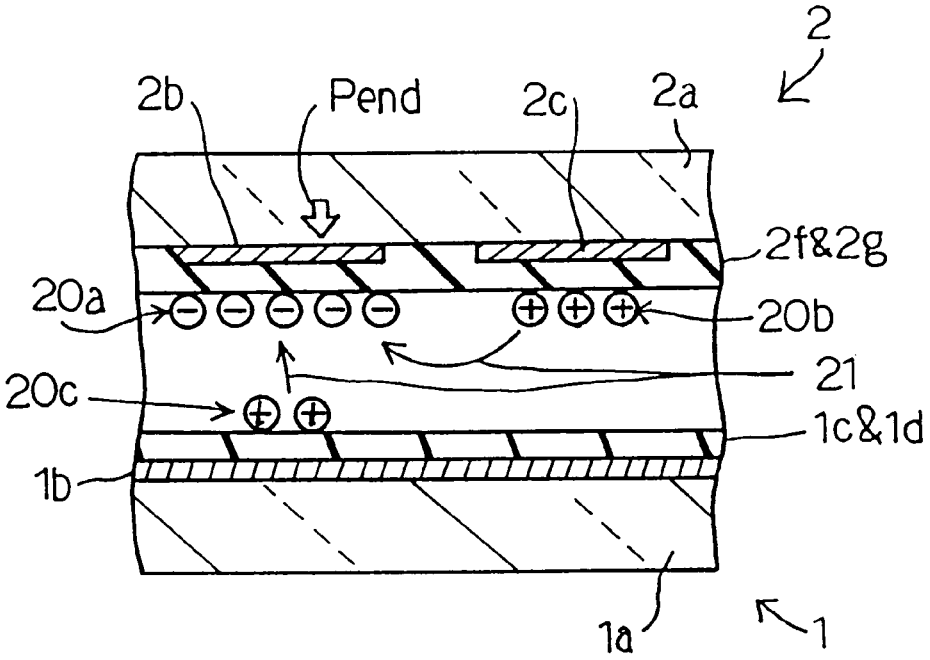
FIGS. 9A and 9B are cross sectional views showing wall charges produced in a pixel during a sustain discharge period.
Figure 9B:
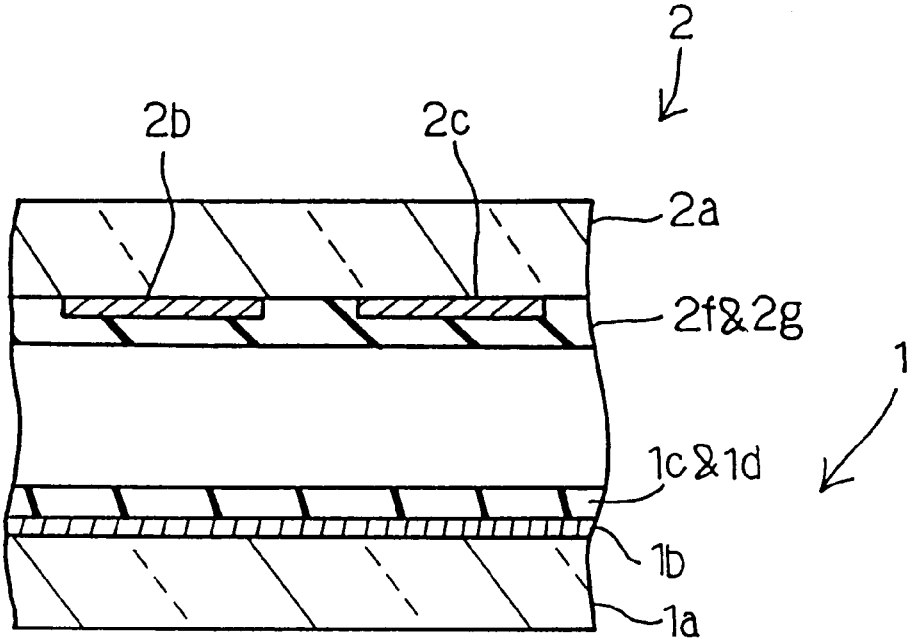

FIGS 9A and 9B illustrate the wall charges produced in one of the selected pixels 5 during the sustain discharge period C. Layers and electrodes of the selected pixel 5 are labeled with the same references designating the corresponding layers and electrodes of the pixel shown in FIG. 1. In this instance, the dielectric layer 1*c* and the phosphor layer 1*d* as a whole constitute first dielectric structure, and the dielectric layer 2*f* and the protective layer 2*g* form in combination a second dielectric structure.

When the sustain discharge takes place due to the positive sustain pulse Pend applied to the scanning electrode 2*b*, the negative wall charge 20*a* is accumulated under the scanning electrode 2*b*, and the positive wall charge 20*b* is accumulated under the sustain electrode 2*c*. The positive wall charge 20*c* is induced on the first dielectric structure under the scanning electrode 2*b* as shown in FIG. 9A. The electric force lines 21 are directed from the positive wall charges 20*b*/20*c* to the negative wall charge 20*a*, and the protective layer 2*g* of magnesium oxide is liable to emit secondary electron due to ion-bombardment.

In this situation, the negative erasing pulse Psue- is superposed on the internal potential between the scanning electrode 2*b* and the sustain electrode 2*c* due to the wall charges 20*a*/20*b*, and causes the erasing discharge to take place. The erasing discharge erases the negative/positive wall charges 20*a*/ 20*b*/20*c* from the first and second dielectric structure as shown in FIG. 9B. The negative erasing pulse Psue− with the relatively low pulse height erases most of the wall charges 20*a* to 20*c* through the erasing discharge, because the magnesium oxide layer 2*g* under the scanning electrode 2*b* is liable to emit the secondary electron due to the electric force lines 21.

Moreover, the positive wall charge 20*c* and the negative erasing pulse Psue− with the low pulse height decrease the negative charge attracted toward the data electrode 1*b*, and the negative charge accumulated on the first dielectric structure is negligible. Thus only, a negligible amount of negative charge is left over the data electrode 1*b*, and the cancellation due to the negative charge is ignoreable in the write-in discharge period of the next sub-field. This results in improvement of the data write-in characteristics, and the selected pixels 5 are surely fired without the priming period in the next sub-field.

Finally, the sustain pulse Psus and the erasing Psue− are negative, and the ion-bombardment on the phosphor layer 1*d* is negligible. For this reason, the phosphor layer 1*d* is never deteriorated, and the duration of life is prolonged.

Figure 10:
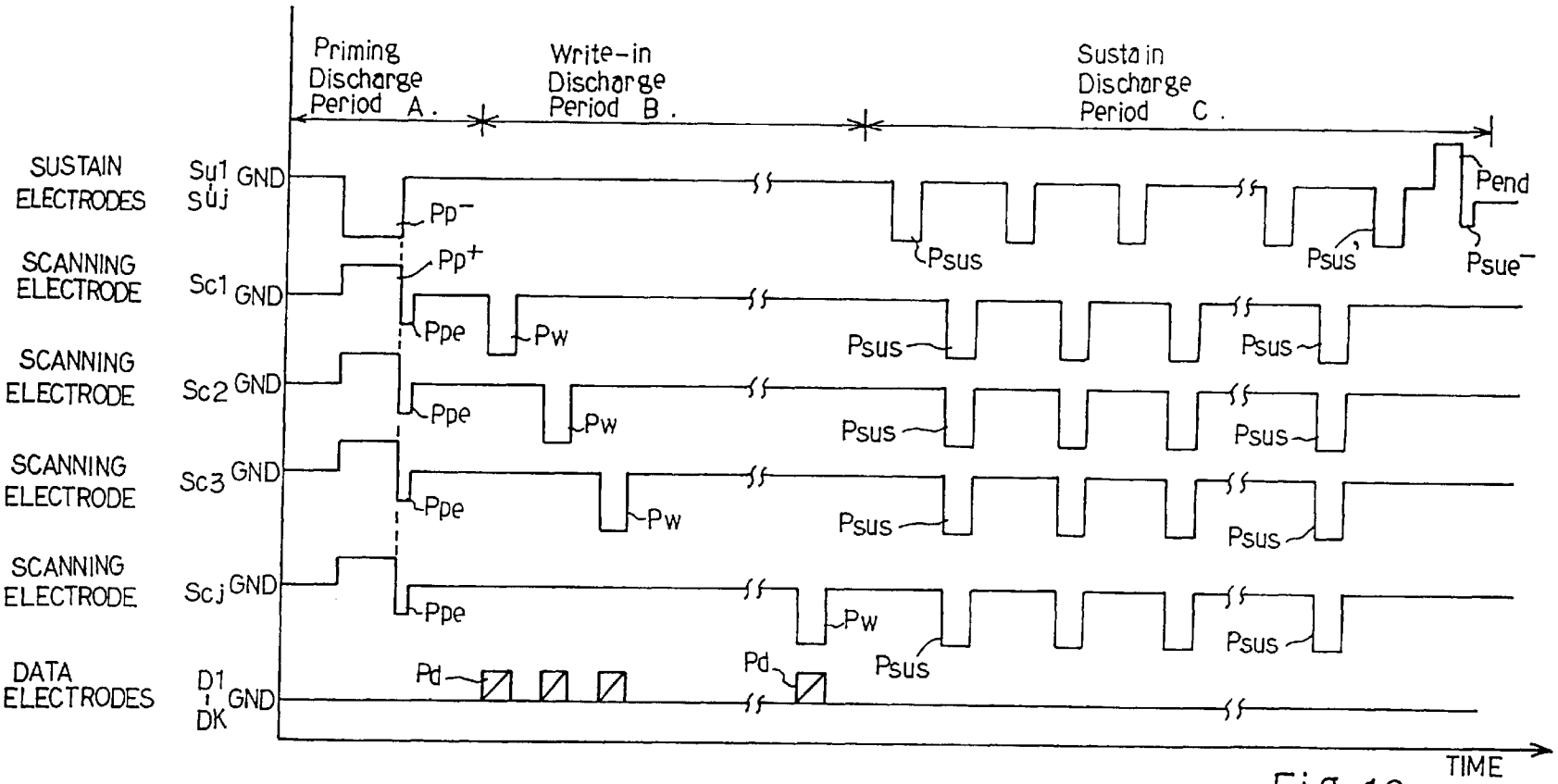
FIG. 10 is a timing chart showing a modification of the controlling method shown in FIG. 8.

Additionally, the positive sustain pulse Pend and the negative erasing pulse Psue− may be applied to the sustain electrodes Sul to Suj as shown in FIG. 10. After the final negative sustain pulse Psus', the positive sustain pulse Pend is applied to all the sustain electrodes Sul to Suj, and the negative erasing pulse Psue− follows.

Second Embodiment

Figure 11:
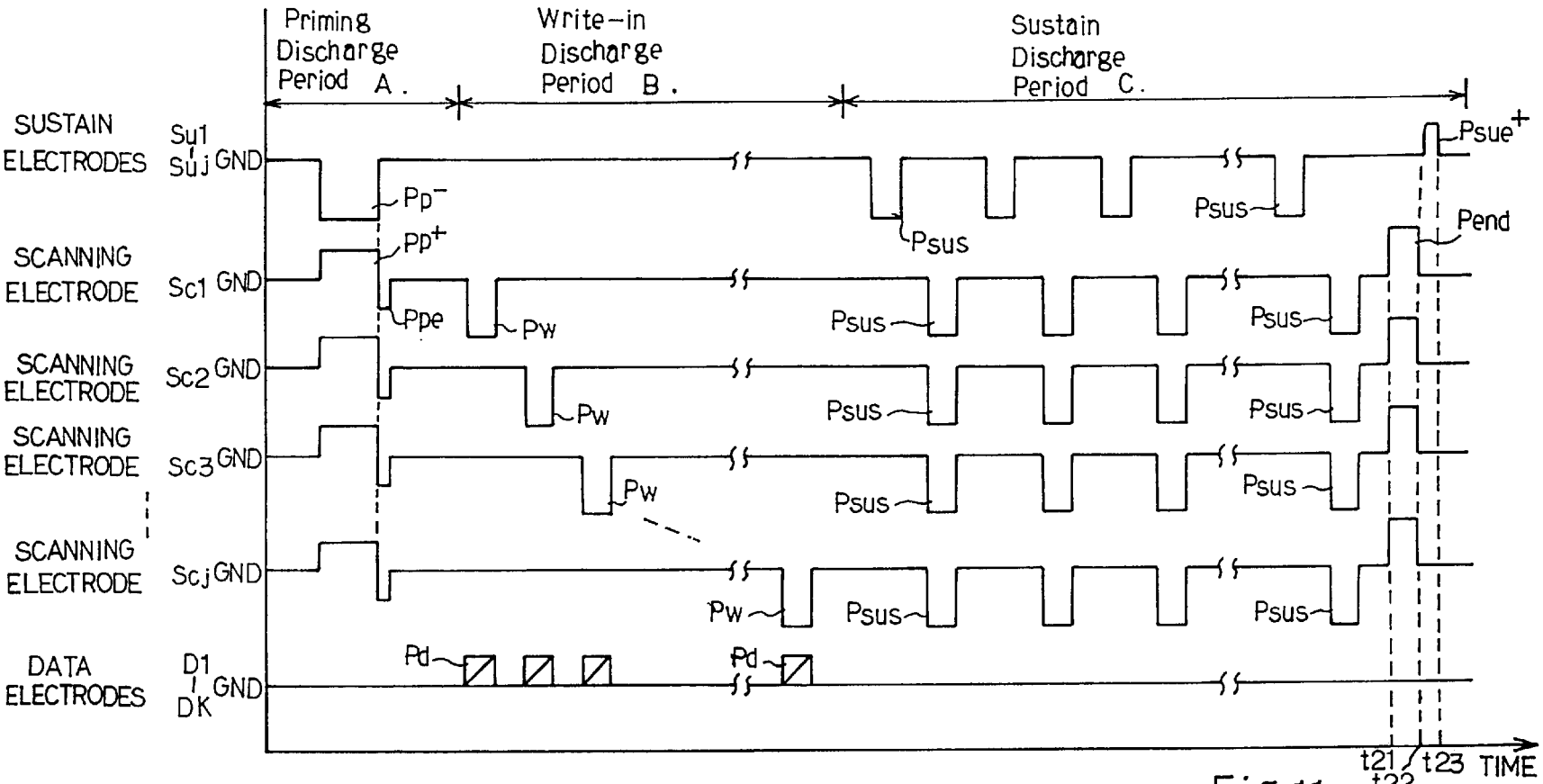
FIG. 11 is a timing chart showing another method of controlling an alternating current plasma display panel according to the present invention.

FIG. 11 illustrates another controlling method embodying the present invention. The priming discharge period A, the write-in discharge period B and the sustain discharge period C consitute a sub-field, and the sub-field is repeated with or without the priming discharge period A. The negative priming pulse Pp−, the positive priming pulse Pp+, the negative erasing pulse Ppe, the negative scanning pulse Pw and the negative data pulse Pd are supplied to the sustain electrodes Sul to Suj, the scanning electrodes Scl to Scj and the data electrodes Dl to Dk in the priming discharge period A and the write-in discharge period B in a similar manner to those of the first embodiment. For this reason, the priming discharge period A and the write-in discharge period B are not described hereinbelow.

In the sustain discharge period C, the negative sustain pulse Psus is repeatedly applied to the sustain electrodes Sul to Suj and the scanning electrodes Scl to Scj so as to make the selected pixels 5 fired. The positive sustain pulse Pend is applied to the scanning electrodes Scl to Scj between time t21 and time t22, and a positive erasing pulse Psue+ is applied to the sustain electrodes Sul to Suj from time t22 to time t23. The positive erasing pulse Psue+ has the pulse height ranging from 50 volts to 100 volts, and the pulse width ranges from 0.5 microsecond to 2 microseconds and, preferably, between 0.5 microsecond to 1 microsecond.

The positive sustain pulse Psus and the positive erasing pulse Psue+ achieve all the advantages of the first embodiment. The positive electric charge is accumulated over the data electrodes Dl-Dk associated with the selected pixels 5 due to the positive erasing pulse Psue+, and is superposed on the potential between the scanning electrodes Scl-Scj and the data electrodes Dl-Dk in the write-in discharge period B of the next sub-field. For this reason, the pixels to be fired are selected by using the scanning pulse Pw with the pulse height lower than that used in the first embodiment. However, the electric charge is left over the data electrodes Dl-Dk. The data pulse Pd used in the second embodiment requires a pulse height larger than that of the first embodiment for overcoming a potential difference due to the electric charge.

In the second embodiment, the positive sustain pulse Pend and the positive erasing pulse Psue+ are applied to the scanning electrodes Scl to Scj and the sustain electrodes Sul to Suj, respectively. In a modification of the second embodiment, the positive sustain pulse Pend and the positive erasing pulse Psue+ may be applied to the sustain electrodes Sul to Suj and the scanning electrodes Scl to Scj, respectively.

Third Embodiment

Figure 12:
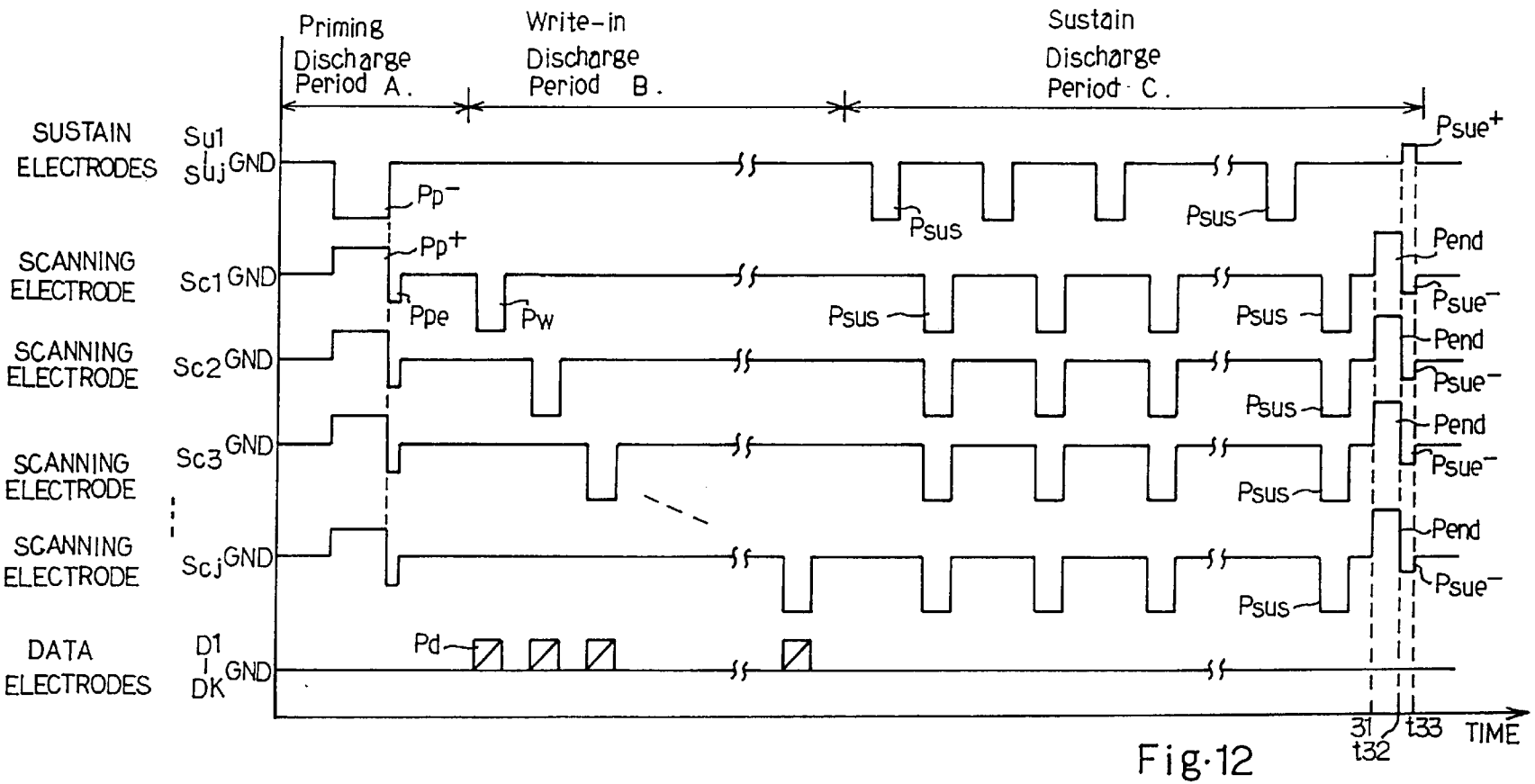
FIG. 12 is a timing chart showing yet another method of controlling an alternating current plasma display panel according to the present invention.

FIG. 12 illustrates yet another controlling method embodying the present invention. The priming discharge period A, the write-in discharge period B and the sustain discharge period C constitute a sub-field, and the sub-field is repeated with or without the priming discharge period A. The negative priming pulse Pp−, the positive priming pulse Pp+, the negative erasing pulse Ppe, the negative scanning pulse Pw and the negative data pulse Pd are supplied to the sustain electrodes Sul to Suj, the scanning electrodes Scl to Scj and the data electrodes Dl to Dk in the priming discharge period A and the write-in discharge period B in a similar manner to those of the first embodiment. For this reason, the priming discharge period A and the write-in discharge period B are not described hereinbelow.

In the sustain discharge period C, the positive sustain pulse Pend is applied to the scanning electrodes Scl to Scj between time t31 and and time t32. Thereafter, a positive erasing pulse Psue+ is applied to the sustain electrodes Sul to Suj between time t32 and time t33, and a negative erasing pulse Psue− is further applied to the scanning electrodes Scl to Scj between time t32 and time t33. The positive erasing pulse Psue+ and the negative erasing pulse Psue− ranges from 0.5 microsecond to 2 microsecond and, preferably between 0.5 microsecond and 1 microsecond. The positive erasing pulse Psue+ and the negative erasing pulse Psue− are regulated in such a manner that the total pulse height falls within the range between 50 volts and 100 volts.

The positive sustain pulse Pend and the erasing pulses Psue+/Psue− achieve all the advantages of the first and second embodiments. The two kinds of erasing pulses Psue+/Psue− are desirable for controlling the erased state. If the pulse height of the positive erasing pulse Psue+ and the pulse height of the negative erasing pulse Psue− are appropriately regulated, the electric charge over the data electrodes dl to Dk are perfectly erased, and the write-in potential in the period B is made uniform over all the pixels 5.

In a modification of the third embodiment, the positive sustain pulse Pend may be applied to the sustain electrodes Sul to Suj after the final negative sustain pulse Psus, In this instance, the positive erasing pulse Psue+ and the negative erasing pulse Psue− are concurrently applied to the scanning electrodes Scl to Scj and the sustain electrodes Sul to Suj, respectively.

Fourth Embodiment

Figure 13:
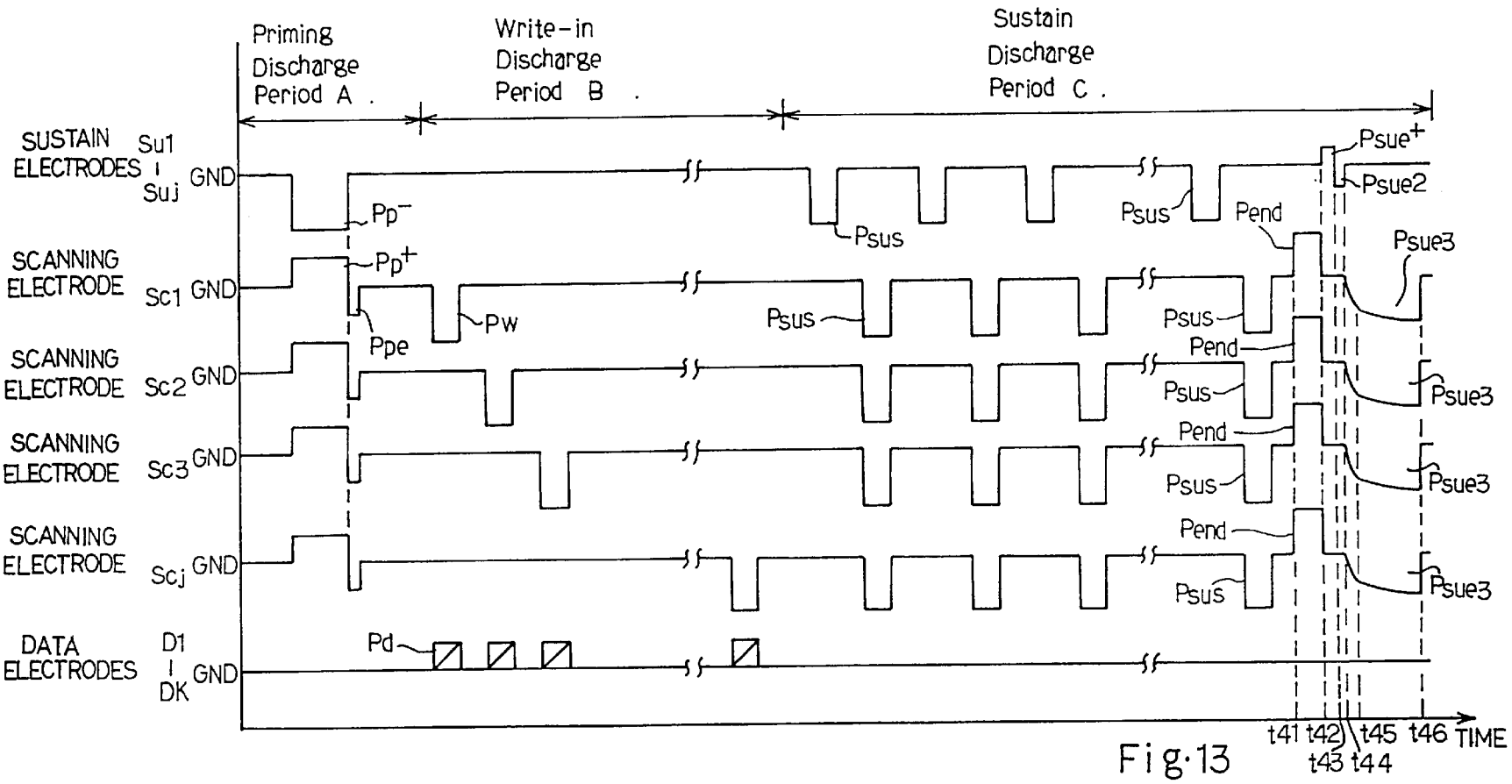
FIG. 13 is a timing chart showing still another method of controlling an alternating current plasma display panel according to the present invention.

FIG. 13 illustrates still another controlling method embodying the present invention. The priming discharge period A, the write-in discharge period B and the sustain discharge period C constitute a sub-field, and the sub-field is repeated with or without the priming discharge period A. The negative priming pulse Pp−, the positive priming pulse Pp+, the negative erasing pulse Ppe, the negative scanning pulse Pw and the negative data pulse Pd are supplied to the sustain electrodes Sul to Suj, the scanning electrodes Scl to Scj and the data electrodes Dl to Dk in the priming discharge period A and the write-in discharge period B in a similar manner to those of the first embodiment. For this reason, the priming discharge period A and the write-in discharge period B are not described hereinbelow.

In the sustain discharge period C, the positive sustain pulse Pend is applied to the scanning electrodes Scl to Scj between time t41 and time t42. A positive erasing pulse Psue+ is applied to the sustain electrodes Sul to Suj between time t42 and time t43. The positive erasing pulse Psue+ has the pulse width ranging from 0.5 microsecond to 2 microseconds and, preferably, between 0.5 microsecond to 1 microsecond. The pulse height of the positive erasing pulse Psue+ is dependent on the pulse width, and usually ranges from 50 volts to 100 volts.

In order to ensure the erasing, a negative erasing pulse Psue 2 is applied to the sustain electrodes Sul to Suj between time t43 and time t44, and a negative erasing signal Psue3 is applied to the scanning electrodes Scl to Scj between time t44 and time t46. The negative erasing signal Psue3 rapidly goes down from time t44 to time t45, and gradually decreases the gradient from time t45 to time t46. Such a mild waveform ensures the erasing.

The positive sustain pulse Pend and the positive/negative erasing signals Psue+/Psue2/Psue3 achieves all the advantages of the third embodiment. The negative erasing pulse Psue2 and the negative erasing pulse Psue3 ensure the erasing. In the third embodiment, the positive erasing pulse Psue+ is applied in synchronism with the negattive erasing pulse Psue−. On the other hand, the three erasing pulses Psue+, Psue2 and Psue3 has independent timings, and, for this reason, the fourth embodiment is easier for controlling rather than the third embodiment.

In a modification of the fourth embodiment, the positive sustain pulse Pend may be applied to the sustain electrodes Sul to Suj after the final negative sustain pulse Psus. In this instance, the positive erasing pulse Psue+ and the negative erasing pulse Psue2 are successively applied to the scanning electrodes Scl to Scj, and the negative erasing signal Psue3 is applied to the sustain electrodes Sul to Suj.

Fifth Embodiment

Figure 14:
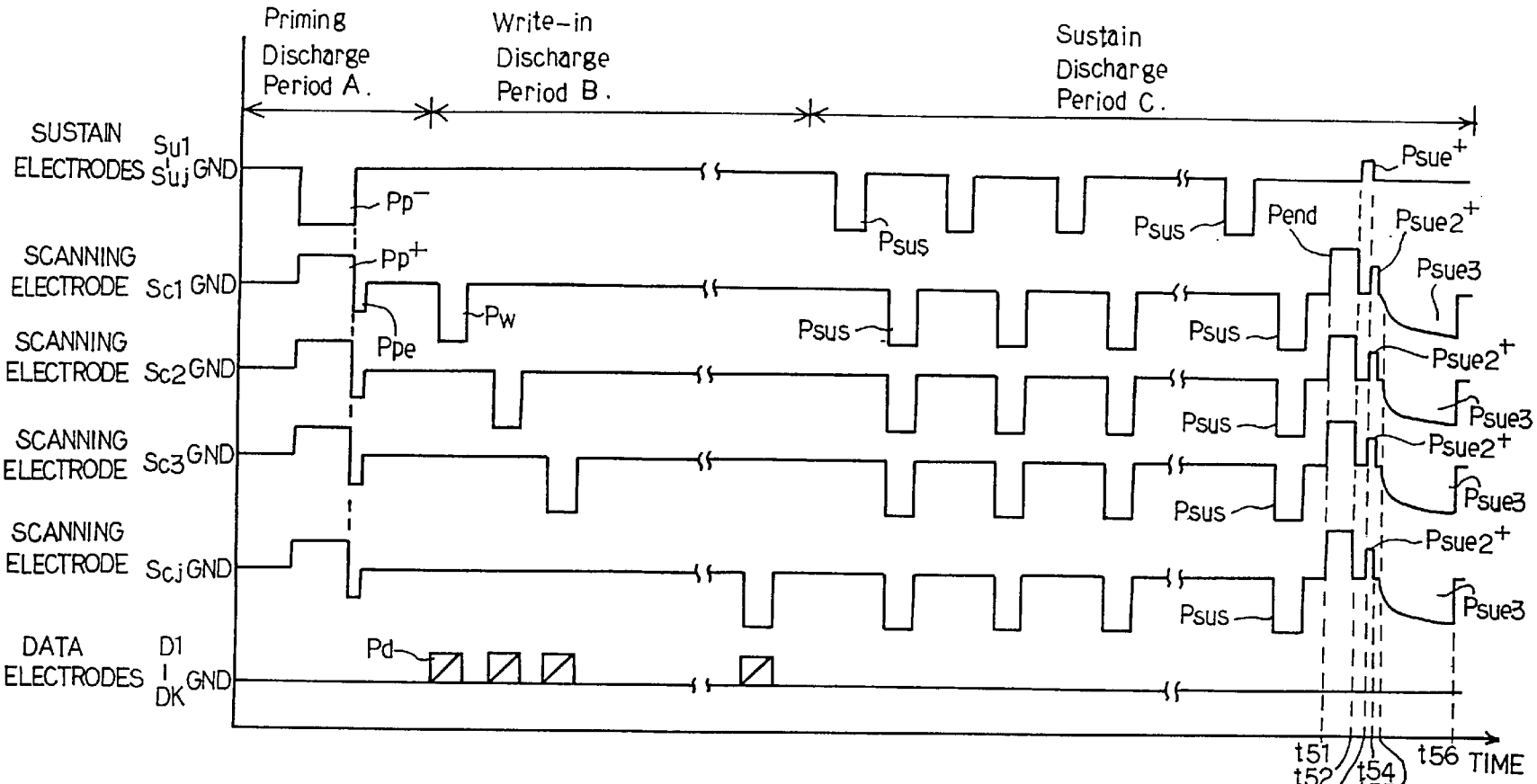
FIG. 14 is a timing chart showing another method of controlling an alternating current plasma display panel according to the present invention.

FIG. 14 illustrates another controlling method embodying the present invention. The priming discharge period A, the write-in discharge period B and the sustain discharge period C constitute a sub-field, and the sub-field is repeated with or without the priming discharge period A. The negative priming pulse Pp−, the positive priming pulse Pp+, the negative erasing pulse Ppe, the negative scanning pulse Pw and the negative data pulse Pd are supplied to the sustain electrodes Sul to Suj, the scanning electrodes Scl to Scj and the data electrodes Dl to Dk in the priming discharge period A and the write-in discharge period B in a similar manner to those of the first embodiment. For this reason, the priming discharge period A and the write-in discharge period B are not described hereinbelow.

In the sustain discharge period C, the positive sustain pulse Pend is applied to the scanning electrodes Scl to Scj between time t51 and time t52. A positive erasing pulse Psue+ is applied to the sustain electrodes Sul to Suj between time t52 and time t53. The positive erasing pulse Psue+ has the pulse width ranging from 0.5 microsecond to 2 microseconds and, preferably, between 0.5 microsecond to 1 microsecond. The pulse height of the positive erasing pulse Psue+ is dependent on the pulse width, and usually ranges from 50 volts to 100 volts.

In order to ensure the erasing, a positive erasing pulse Psue2+ is applied to the scanning electrodes Scl to Scj between time t53 and time t54, and a negative erasing signal Psue3 is applied to the scanning electrodes Scl to Scj between time t55 and time t56. The negative erasing signal Psue3 gradually decreases the gradient from time t55 to time t56. Such a mild waveform ensures the erasing.

The positive sustain pulse Pend and the positive/negative erasing signals Psue+/Psue2+/Psue3 achieves all the advantages of the fourth embodiment. In the fourth embodiment, the second erasing pulse Psue2+ is positive, and the dielectric structure over the data electrodes layer 1*d* are lightly charged with the positive charge between both sustain/screening electrodes and the data electrodes. Thereafter, the negative erasing signal Psue3 is applied to the scanning electrodes Scl to Scj. The negative erasing signal Psue3 uniformly neutralizes the first dielectric structure under both sustain/screening electrodes. This results in a write-in potential lower in pulse height than that of the fourth embodiment.

In a modification of the fifth embodiment, the positive sustain pulse Pend may be applied to the sustain electrodes Sul to Suj after the final negative sustain pulse Psus. In this instance, the positive erasing pulse Psue+ is applied to the scanning electrodes Scl to Scj, the positive erasing pulse Psue2+ is applied to the sustain electrodes Sul to Suj, and the negative erasing signal Psue3 is applied to the sustain electrodes Sul to Suj.

Sixth Embodiment

Figure 15:
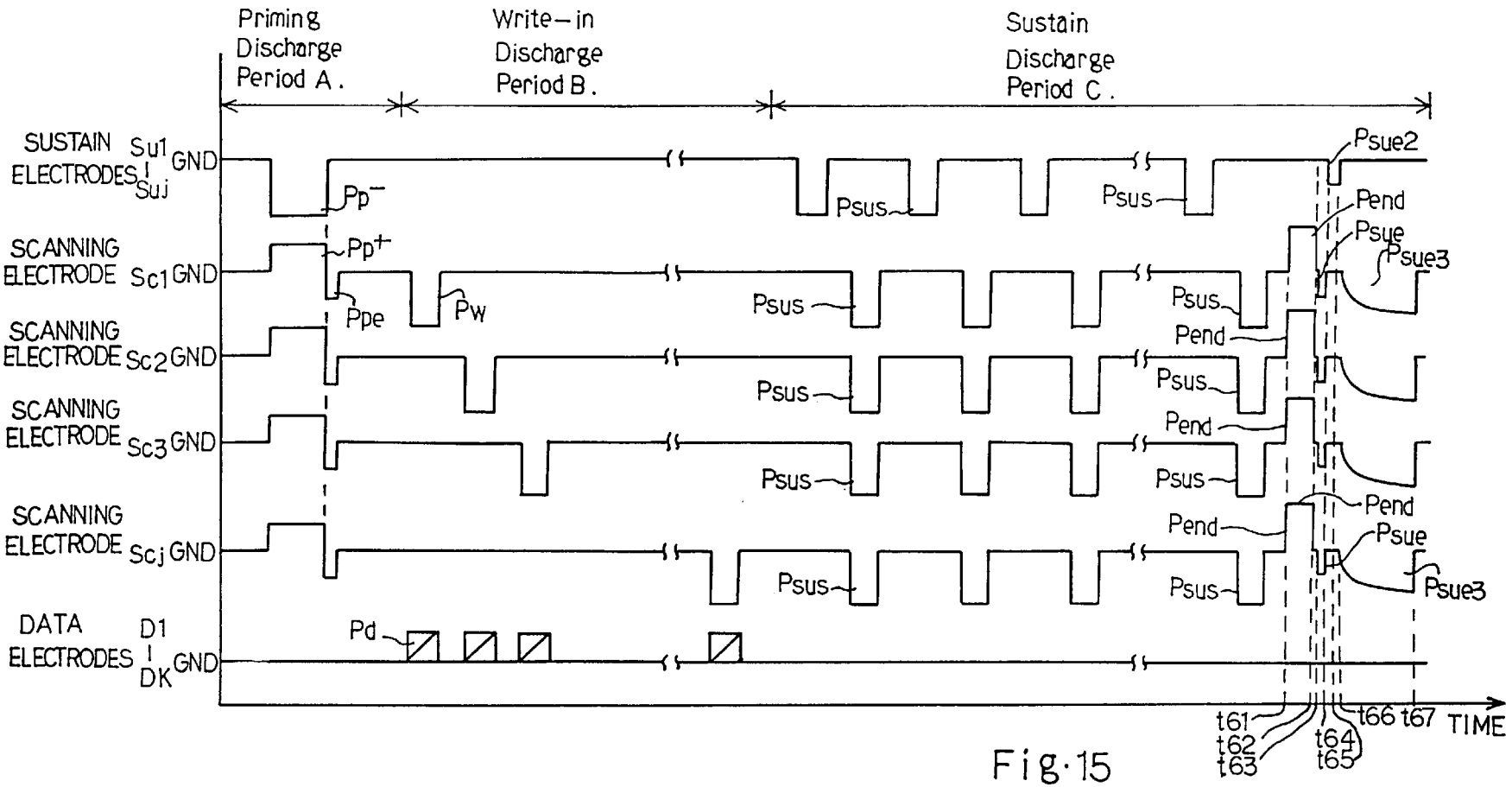
FIG. 15 is a timing chart showing another method of controlling an alternating current plasma display panel according to the present invention.

FIG. 15 illustrates another controlling method embodying the present invention. The priming discharge period A, the write-in discharge period B and the sustain discharge period C constitute a sub-field, and the sub-field is repeated with or without the priming discharge period A. The negative priming pulse Pp−, the positive priming pulse Pp+, the negative erasing pulse Ppe, the negative scanning pulse Pw and the negative data pulse Pd are supplied to the sustain electrodes Sul to Suj, the scanning electrodes Scl to Scj and the data electrodes Dl to Dk in the priming discharge period A and the write-in discharge period B in a similar manner to those of the first embodiment. For this reason, the priming discharge period A and the write-in discharge period B are not described hereinbelow.

In the sustain discharge period C, the positive sustain pulse Pend is applied to the scanning electrodes Scl to Scj between time t61 and time t62. A negative erasing pulse Psue is applied to the scanning electrodes Scl to Scj between time t63 and time t64, and the negative erasing pulse Psue has the pulse width ranging from 0.5 microsecond to 2 microseconds and, preferably, between 0.5 microsecond to 1 microsecond. The pulse height of the negative erasing pulse Psue is dependent on the pulse width, and usually ranges from 50 volts to 100 volts.

Immediately after the recovery of the negative erasing pulse Psue, a negative erasing pulse Psue2 is applied to the sustain electrodes Sul to Suj between time t64 and time 65, and a negative erasing signal Psue3 is applied to the scanning electrodes Scl to Scj between time t66 and time t67. The negative erasing signal Psue3 gradually decreases the gradient from time t66 to time t67 as similar to the fifth embodiment, and the mild waveform ensures the erasing.

The positive sustain pulse Pend and the negative erasing signals Psue/Psue2/Psue3 achieves all the advantages of the fourth embodiment. In the sixth embodiment, all the erasing signals Psue/Psue2/Psue3 are negative. The positive sustain pulse Pend has a relatively large pulse height, and the pulse width is equal to or greater than 10 microseconds. The insulating structure over the data electrodes Dl to Dk accumulates the positive charge over the data electrodes Dl to Dk, and the three negative erasing signals Psue/Psue2/Psue3 erases the positive charges from the insulating structure over the data electrodes Dl to Dk.

In a modification of the sixth embodiment, the positive sustain pulse Pend may be applied to the sustain electrodes Sul to Suj after the final negative sustain pulse Psus. In this instance, the negative erasing pulse Psue is applied to the sustain electrodes Sul to Suj, the negative erasing pulse Psue2 is applied to the scanning electrodes Scl to Scj, and the negative erasing signal Psue3 is applied to the sustain electrodes Sul to Suj.

Seventh Embodiment

Figure 16:
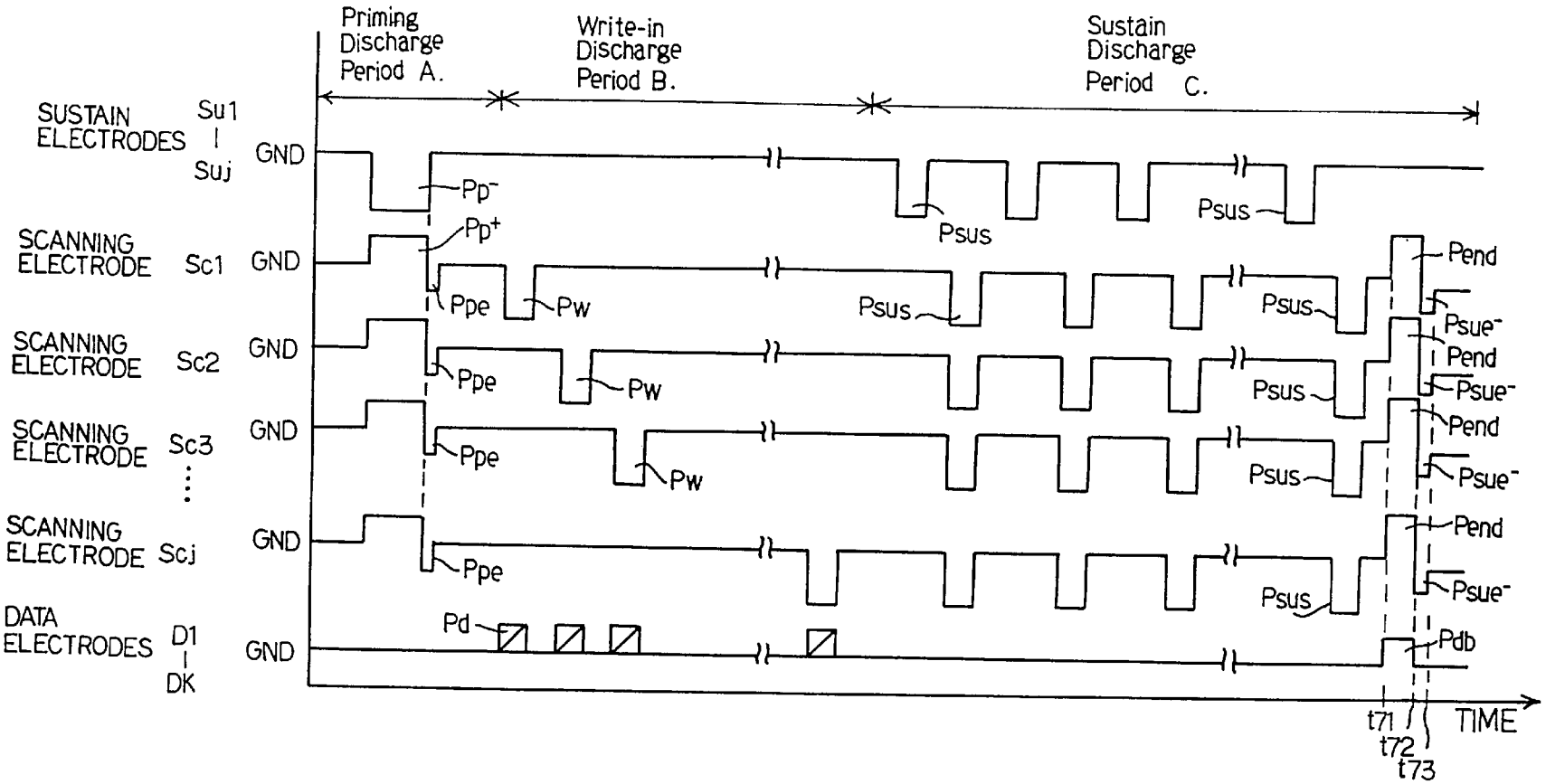
FIG. 16 is a timing chart showing another method of controlling an alternating current plasma display panel according to the present invention.

FIG. 16 illustrates another controlling method embodying the present invention. The controlling method implementing the seventh embodiment is similar to the controlling method shown in FIG. 8 except for a positive protective bias pulse Pdb. The positive sustain pulse Pend is applied to the scanning electrodes Scl to Scj from time t71 to time t72, and the positive protective bias pulse Pdb is also applied to the data electrodes between time t71 and time t72. The positive protective bias pulse Pdb has a pulse height less than the threshold for discharge between the sustain electrodes Sul to Suj and the data electrodes Dl to Dk, and the potential difference between the scanning electrodes Scl-Scj and the data electrodes Dl-Dk is less than the threshold for the discharge therebetween. Thus, the positive protective bias pulse Pdb prevents the non-selected pixels 5 from undesirable misfiring. The negative erasing pulse Psue− is applied to the scanning electrodes Scl to Scj between time t72 and time t73, and erases the wall charges from the first dielectric structure and the second dielectric structure. The negative erasing pulse Psue− has a pulse width ranging from 0.5 microsecond to 2 microseconds and, preferably, between 0.5 microsecond and 1 microsecond.

The positive sustain pulse Pend and the negative erasing pulse Psue− achieves all the advantages of the first embodiment, and the positive protective bias pulse Pdb does not allow the positive sustain pulse Pend to fire the non-selected pixels 5, and improves the contrast of an image produced on the display area 6.

Eighth Embodiment

Figure 17:
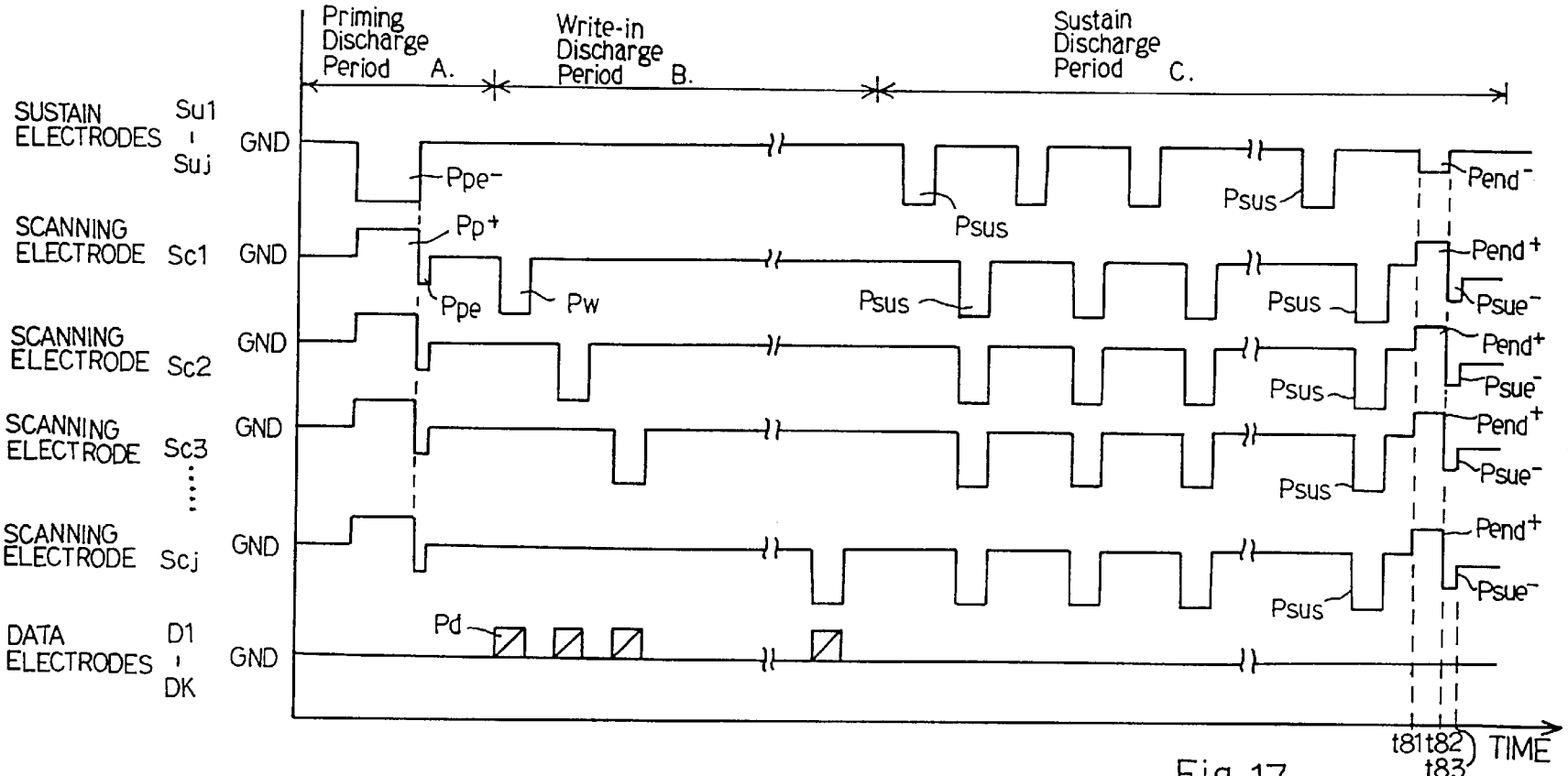
FIG. 17 is a timing chart showing another method of controlling an alternating current plasma display panel according to the present invention.

FIG. 17 illustrates another controlling method embodying the present invention. The controlling method implementing the eighth embodiment is similar to the controlling method shown in FIG. 8 except for positive/negative sustain pulses Pend+/Pend−. The positive sustain pulse Pend+ is applied to the scanning electrodes Scl to Scj from time t81 to time t82, and the negative sustain pulse Pend− is applied to the sustain electrodes Sul to Suj in synchronism with the positive sustain pulse Pend+. The positive sustain pulse Pend+ has a pulse height less than the threshold for the discharge between the scanning electrodes Scl-Scj and the data electrodes Dl-Dk, and the negative sustain pulse Pend− has a pulse height less than the threshold for the discharge between the sustain electrodes Sul-Suj and the data electrodes Dl-Dk. The sum of the positive sustain pulse Pend+ and the negative sustain pulse Pend− is less than the threshold for the discharge between the sustain electrodes Sul-Suj and the scanning electrodes Scl-Scj and is equal to or greater than the minimum sustain potential between the scanning electrodes Scl-Scj and the sustain electrodes Sul-Suj.

Subsequently, the negative erasing pulse Psue− is applied to the scanning electrodes Scl to Scj between time t82 and time t83, and erases the wall charges from the first dielectric structure and the second dielectric structure.

In this instance, the positive sustain pulse Pend of the first embodiment is split into the positive sustain pulse Pend+ and the negative sustain pulse Pend−, and the positive sustain pulse Pend+ and the negative sustain pulse Pend− prevent the non-selected pixels 5 from misfiring, and improves the contrast of an image produced on the display area 6.

A modification of the eighth embodiment, the positive sustain pulse Pend+ and the negative erasing pulse Psue− may be applied to the sustain electrodes Sul to Suj after the final negative sustain pulse Psus. In the modification, the negative sustain pulse Pend− is applied to the scanning electrodes Scl-Scj in synchronism with the positive sustain pulse Pend+.

As will be appreciated from the foregoing description, only the final sustain pulse Pend is positive with respect to the potential level on the data electrodes Dl-Dk in accordance with the present invention, and allows the erasing pulse to effectively erase the wall charges from the first/second dielectric structure without sacrifice of the durability of the phosphor layer 1*d*.

Although particular embodiments of the present invention have been shown and described, it will be obvious to those skilled in the art that various changes and modifications may be made without departing from the spirit and scope of the present invention.

For example, if the positive erasing pulse Psue+ and the negative erasing pulse Psue2 achieve good erased state, the negative erasing signal Psue3 would be skipped in the fourth, fifth and sixth embodiments.

The erasing pulse Psue− used in the seventh/eighth embodiment may be changed to the erasing pulse or pulses used in any one of the second to sixth embodiment.

In the first to eight embodiments, the pulses go up or go down from the ground level. However, if the pulses are established in the relative relation described hereinbefore, the pulses may be changed from a certain positive potential level or a certain negative potential level.

The pulse height and the pulse width described hereinbefore in connection with the first to eighth embodiments are changeable depending upon the plasma display panel to which the present invention appertains.

What is claimed is:

1. A method of controlling an alternating current plasma display panel including a plurality of data electrodes covered with a first dielectric structure, a plurality of scanning electrodes covered with a second dielectric structure spaced from said first dielectric structure for forming a space filled with discharging gas and a plurality of sustain electrodes covered with said second dielectric structure and respectively paired with said plurality of scanning electrodes for forming a plurality of electrode pairs, each of said plurality of data electrodes and each of said plurality of electrode pairs defining one of a plurality of pixels selectively fired, said method comprising the steps of a) applying a scanning pulse sequentially to said plurality of scanning electrodes and a data pulse selectively to said plurality of data electrodes so as to create a first internal potential available for firing in certain pixeles selected from said plurality of pixels, and b) alternately applying a first sustain pulse negative with respect to a potential level on said plurality of data electrodes to said plurality of sustain electrodes and said plurality of scanning electrodes so as to make said certain pixels fired, c) applying a second sustain pulse positive with respect to said potential level on said plurality of data electrodes to either sustain or scanning electrodes so as to accumulate wall charges on said first insulating structure and said second insulating structure for creating a second internal potential expressed by a first electric force line directed from said first insulating structure to said second insulating structure and a second electric force line between a first area of said second insulating structure adjacent to said plurality of scanning electrodes and a second area of said second insulating structure adjacent to said plurality of sustain electrodes, and d) erasing said wall charges from said first insulating structure and said second insulating structure, and in which a first erasing pulse is applied to either sustain or scanning electrodes.

2. The method as set forth in claim 1, in which said first erasing pulse is negative with respect to said potential level on said plurality of data electrodes, and is applied to said either sustain or scanning electrodes applied with said second sustain pulse in said step c).

3. The method as set forth in claim 1, in which said first erasing pulse is positive with respect to said potential level on said plurality of data electrodes, and is applied to said either sustain or scanning electrodes in said step d) opposite to said either sustain or scanning electrodes in said step c).

4. The method as set forth in claim 1, in which said first erasing pulse is applied to said either sustain or scanning electrodes in said step d) identical with said either sustain or scanning electrodes in said step c), and a second erasing pulse is applied to either sustain or scanning electrodes opposite to said either sustain or scanning electrodes in said step c).

5. The method as set forth in claim 4, in which said first erasing pulse is negative with respect to said potential level on said plurality of data electrodes, and said second erasing pulse is positive with respect to said potential level on said plurality of data electrodes.

6. The method as set forth in claim 5, in which said first erasing pulse is synchronous with said second erasing pulse.

7. The method as set forth in claim 5, in which said first erasing pulse is applied after said second erasing pulse.

8. The method as set forth in claim 7, in which a third erasing pulse is applied to said either sustain or scanning electrodes applied with said second erasing pulse between said second erasing pulse and said first erasing pulse, and is negative with respect to said potential level on said plurality of data electrodes.

9. The method as set forth in claim 8, in which said first erasing pulse gradually decreases a pulse height thereof with time.

10. The method as set forth in claim 7, in which a third erasing pulse is applied to said either sustain or scanning electrodes applied with said first erasing pulse before said second erasing pulse and said first erasing pulse, and is positive with respect to said potential level on said plurality of data electrodes.

11. The method as set forth in claim 4, in which said first erasing pulse and said second erasing pulse are negative with respect to said potential level on said plurality of data electrodes, and a third erasing pulse is applied to said either sustain or scanning electrodes applied with said first erasing pulse between said second erasing pulse and said first erasing pulse.

12. The method as set forth in claim 11, in which said first erasing pulse gradually decreases a pulse height thereof with time.

13. The method as set forth in claim 2, in which a protective bias pulse is applied to said plurality of data electrodes in synchronism with said second sustain pulse so as to prevent the others of said plurality of pixels except for said certain pixels from misfiring.

14. The method as set forth in claim 13, in which said protective bias pulse is positive with respect to said potential level on said plurality of data electrodes in said step b).

15. The method as set forth in claim 14, in which said protective bias pulse makes a potential difference between said plurality of sustain electrodes and said plurality of data electrodes and a potential difference between said plurality of scanning electrodes and said plurality of data electrodes less than thresholds for discharging therebetween.

16. The method as set forth in claim 1, in which a third sustain pulse is applied to either sustain or scanning electrodes opposite to said either sustain or scanning electrodes in said step c) in synchronism with said second sustain pulse, and is negative with respect to said potential level on said plurality of data electrodes for preventing remaining pixels except for said certain pixels from misfiring.

17. The method as sest forth in claim 1, further comprising the step of carrying out a priming discharge before said step a).

18. The method according to claim 1, wherein the erasing pulse is applied to only said sustain electrode or only to said scanning electrodes.

19. The method according to claim 2, wherein the erasing pulse has a smaller height relative to a sustain pulse and wherein the erasing pulse is applied to only said sustain electrode or only to said scanning electrodes.

20. The method according to claim 17, wherein the erasing pulse is applied to only said sustain electrode or only to said scanning electrodes.

* * * * *

UNITED STATES PATENT AND TRADEMARK OFFICE

CERTIFICATE OF CORRECTION

PATENT NO.: 6,124,849
DATED: September 26, 2000
INVENTOR(S): Kazuhiro ITO , Tadashi NAKAMURA It is certified that error(s) appears in the above-identified patent and that said Letters Patent is hereby corrected as shown below:

Column 4, line 8, delete "i " insert --in--;

line 27, delete "n-1" insert --n=1--.

Column 8, line 35, delete "2" insert --1--.

Column 9, line 42, delete "first" insert --fires--;

line 43, delete "e".

Column 11, line 65, delete "d1" insert --D1--.

Column 12, line 3, delete "Psus," insert --Psus.--

Column 16, line 15, delete "pixeles" insert --pixels--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*